United States Patent [19]

Camacho

[11] 4,181,504

[45] Jan. 1, 1980

[54] METHOD FOR THE GASIFICATION OF CARBONACEOUS MATTER BY PLASMA ARC PYROLYSIS

[75] Inventor: Salvador L. Camacho, Raleigh, N.C.

[73] Assignee: Technology Application Services Corp., Raleigh, N.C.

[21] Appl. No.: 827,867

[22] Filed: Aug. 26, 1977

Related U.S. Application Data

[63] Continuation-in-part of Ser. No. 645,413, Dec. 30, 1975, abandoned.

[51] Int. Cl.[2] ..... C10J 03/08

[52] U.S. Cl. ..... 48/197 R; 13/2 P; 48/202; 48/209; 48/210; 201/19; 110/250; 252/373

[58] Field of Search ..... 252/373; 423/648; 48/197 R, 210, 65, 92, 202, 206, 209; 204/170; 219/121 P; 13/2 P; 110/8 E, 18 E, 250; 201/19; 202/219

[56] References Cited

U.S. PATENT DOCUMENTS

| | | | |
|---|---|---|---|
| 701,186 | 5/1902 | Faulkner | 48/92 |
| 1,105,241 | 7/1914 | Benjamen | 48/706 |
| 1,592,860 | 7/1926 | Leonarz | 48/92 |
| 2,093,493 | 9/1937 | Stitzer | 48/206 |
| 2,127,542 | 8/1938 | Stitzer | 48/65 |
| 3,422,206 | 1/1969 | Baker et al. | 219/75 |
| 3,533,739 | 10/1970 | Pelczarski et al. | 48/92 |
| 3,779,182 | 12/1973 | Camacho | 110/8 E |
| 3,841,239 | 10/1974 | Nakamura | 110/8 E |
| 3,870,611 | 3/1975 | Vestal | 48/65 |

OTHER PUBLICATIONS

"Reactions of Coal in a Plasma Jet", Graves et al I +EC, Jan. 1966.

*Primary Examiner*—S. Leon Bashore
*Assistant Examiner*—Peter F. Kratz
*Attorney, Agent, or Firm*—B. B. Olive

[57] ABSTRACT

Apparatus and method for gasification of carbonaceous matter by plasma arc pyrolysis are disclosed. In one embodiment, a refractory-lined furnace is provided with a depression along its base for holding a pool of molten metal which acts as the external electrode for a bank of long arc column plasma torches which provide a heat mass for the process. The plasma arc pressure imparts momentum to the surface of the melt and causes it to flow in cusping eddy currents during the process. Crushed coal is deposited through the roof of the furnace by a rotary feeder in continuous plural streams. The coal is devolatilized in a matter of milli seconds and the volatiles are cracked as the coal falls by gravity through the interior of the furnace. The remaining carbon-rich char collects at plural sites on the surface of the melt and the mounds of char are rotated by the eddy currents. Steam is continuously injected into the furnace to produce hydrocarbon gases through reaction with the carbon-rich char. A residence time of five to thirty minutes produces carbon utilization of up to 92 percent. The hot raw gases are directed through a gas cooler where heat is extracted for producing the process steam and the cooled raw gases are upgraded to pipeline quality by conventional carbon dioxide and moisture removal techniques and by methanization with catalysts. The raw gas may also be burned directly as a medium-Btu gas or used as a reductant in the direct reduction of iron ore.

32 Claims, 20 Drawing Figures

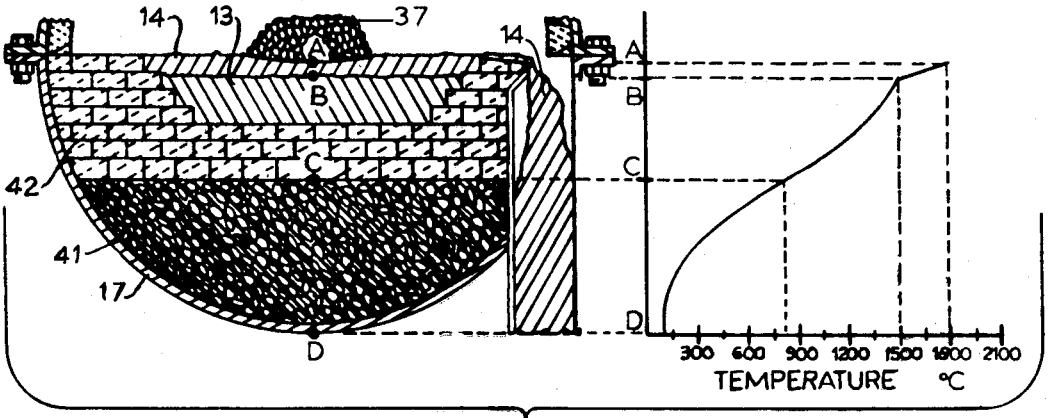
FIG. 11
FIG. 12
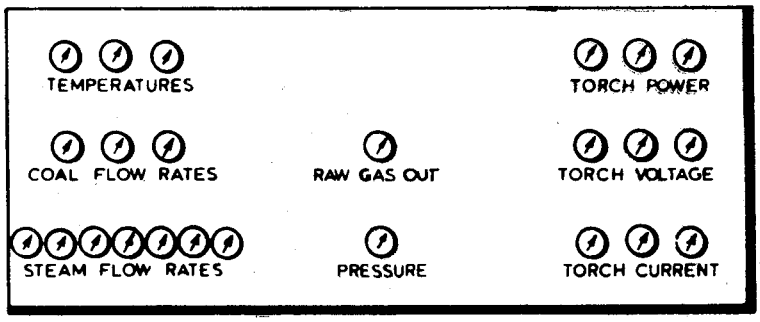
FIG. 13
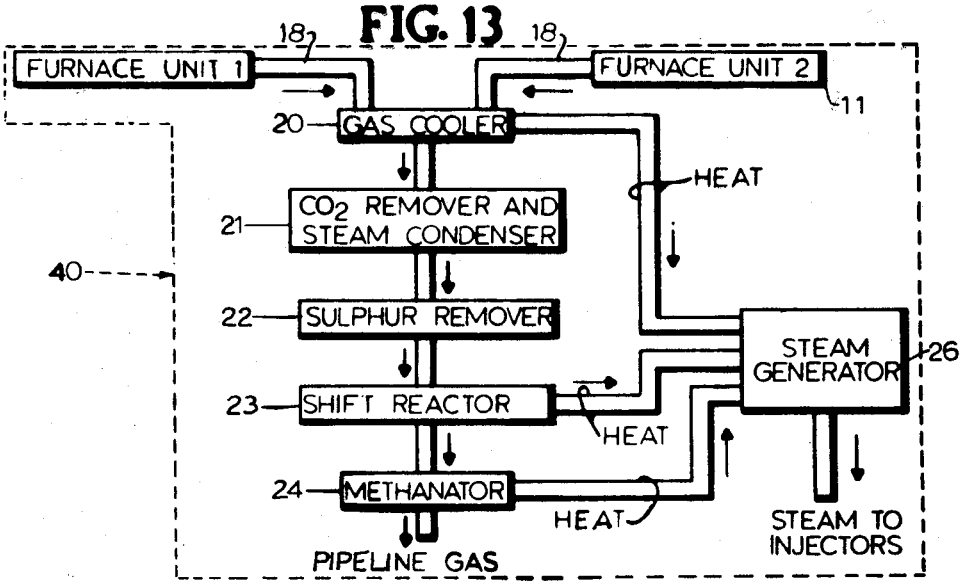

METHOD FOR THE GASIFICATION OF CARBONACEOUS MATTER BY PLASMA ARC PYROLYSIS

CROSS-REFERENCE TO RELATED APPLICATION

This is a continuation-in-part of application Ser. No. 645,413, filed Dec. 30, 1975, now abandoned and having the same title.

BACKGROUND OF THE INVENTION

1. Field of the Invention

The invention relates to apparatus and method for producing fuel gases from carbonaceous matter. In particular, the invention relates to coal gasification by plasma arc torch pyrolysis.

2. Description of the Prior Art

It is well known that the finding rate of natural gas and oil in the Western World has greatly decreased in recent years while the demand has steadily risen. As a result, the United States has become increasingly dependent on foreign sources to meet its gas and oil demands. Recently, it has been estimated by the Institute of Gas Technology that the demand for natural gas in the United States will exceed production in the United States (including imports from Mexico and Canada) by 7.8 trillion cubic feet in 1980 and 18.3 trillion cubic feet in 1990 unless some new means can be found to supplement the supply.

In order to assure the energy independence of the United States, there is an acute need to develop a new source of clean fuel to meet the energy demand. In the United States, coal and oil shale are the only remaining fossil fuel sources which are abundantly available. Numerous attempts have been made to develop a workable process for coal gasification. However, to date there is no known process which can satisfactorily convert the energy of virtually any type of coal into a pipeline quality gas.

The basic requirement for coal gasification includes heating the coal to reaction temperature in the presence of selected reactants to induce certain chemical reactions. The combination of coal, heat and a reactant, such as water, produces raw gas which is essentially hydrogen, carbon monoxide and methane. The raw gas can be further shifted and beneficiated by conventional means to produce a gas which is essentially methane.

As stated in the May 1973 issue of "Pipeline and Gas Journal" at pages 29–31, the conventional coal gasification processes utilize a portion of the input coal for burning to generate the heat required by the process. That is, the endothermic heat is applied by injecting into the reaction chamber enough air or pure oxygen to cause combustion of part of the coal. Normally, between 14% to 26% of the coal charged into the process is burned to supply the endothermic heat requirement. This portion of the carbon is essentially "lost" to the process, since it forms carbon dioxide which has no heating value. The use of pure oxygen to cause combustion results in a raw gas which is diluted by carbon dioxide. Combustion with air further dilutes the outgas with nitrogen to a level which makes the process uneconomical.

The most familiar prior art process is the Lurgi process developed in Germany in the 1930's. Similar processes include the Winkler and Koppers-Totzek processes.

The Lurgi gasifier includes a water-jacketed furnace having a metal gate on which the input coal rests. Oxygen or air is introduced below the grate in sufficient quantity to cause combustion of approximately 20% of the coal. The combustion provides the necessary heat to gasify the remaining coal in the presence of steam. Ash and char fall through the grate and are taken out at the bottom. The obvious disadvantage of the Lurgi process is that approximately one-fifth or more of the coal is oxidized in order to sustain the operating temperature within the furnace. This oxidation results in a substantial dilution of the raw gas by carbon dioxide. If air is injected into the furnace for combustion instead of costly pure oxygen, the raw gas is further diluted by nitrogen. The control of the Lurgi process is, at best, complex. Assume that an input coal is introduced with a high moisture content. This will require additional heat for gasification. Since the heating process is combustion in nature, additional heat means additional oxygen to burn additional coal. Since the coal-to-steam ratio is disturbed by burning more coal, the steam flow would also have to be adjusted. The net effect is an adjustment of both oxygen and steam flows. The incremental heat is necessarily limited by the fusion temperature of the coal and ash and the melting point of the metal grate. Too high a temperature will fuse the char and ash and may also melt the metal grate. This limitation forces the Lurgi process to use coal of 9,000 Btu per pound or less, for fear of melting the grate or fusing the coal ash and plugging the grate. It is obvious, therefore, that to control the Lurgi process it is necessary to adjust all of the input parameters: oxygen, steam and coal.

The Atgas process developed by Applied Technology Corporation represents a significant departure from the Lurgi process. According to the Atgas process, a pool of molten iron is provided at the base of the gasifier furnace. The iron is initially melted by natural gas burners. After the iron is melted, coal which has been ground to about one-eighth inch is injected with a lance into the molten iron bath and, at the same time, oxygen is blown into the bath. A portion of the carbon in the coal and the oxygen reacts to form carbon dioxide and to produce the heat necessary to sustain the process. The heat of the process causes the coal volatiles to be immediately released. The remaining carbon dissolves into the bath where it reacts with steam to yield essentially carbon monoxide and hydrogen gas. The process is conducted at approximately 2,500 degrees Fahrenheit. The Atgas process has as a principal advantage its ability to significantly reduce the hydrogen sulfide that enters the raw gas. A large percentage of the sulphur in the coal dissolves in the iron and then diffuses to a molten slag layer floating on the top of the iron. However, the drawback, which is common to Atgas, Lurgi, Koppers-Totzek, Winkler and all other known processes for converting both the volatiles and char of coal to gas, is that a large portion of the carbon must be burned within the furnace in order to supply the heat requirements for the process. As a result, the raw gas is diluted with large amounts of carbon dioxide having no heating value. If the process is not equipped with a costly supply of pure oxygen gas, the raw gas is further diluted by nitrogen from the air used for the combustion. Another problem with the Atgas process is that the injection of coal, steam and oxygen into the molten iron bath presents serious problems of material handling. Furthermore, the injection of steam is extremely dangerous since the presence of condensation in the steam injection line could lead to a serious explosion. The Atgas, Lurgi and other processes for coal gasification for pipeline gas are described in "Evaluation of Coal - Gasification Technology; Part 1, Pipeline-Quality Gas" prepared for the Office of Coal Research, Department of the Interior (October 1973).

Garrett Research and Development Company, Inc., of La Verne, California, has proposed a flash pyrolysis technique for partially gasifying coal during a very short residence time. Coal is rapidly heated by combustion in an oxygen-deficient chamber and the volatiles are stripped off to produce a hydrocarbon-rich gas. The Garrett process does not gasify the fixed carbon in the coal, i.e., only the volatile matter is released by heating and the remaining char is recovered to be utilized as a solid fuel for electrical power generation. As in all other known coal gasification processes, the process heat for the Garrett Process is supplied by combustion of the volatile gases with pure oxygen or air. The Garrett process is termed a "pyrolysis" process since the volatiles are released in a chamber deficient of oxygen to completely burn the volatile gases. It should be noted that the Garrett process provides only a partial gasification of coal in that only the volatiles are released. The residence time of the coal is only two seconds or less, thus making it impossible to gasify the fixed carbon in the coal. The char, comprised of the fixed carbon plus ash, remains after the partial gasification and is adapted to be conveyed to a nearby electrical power generator as a solid cake fuel. The Garrett process is described in the June 1974 issue of "Chemical Engineering Progress" at pages 72–75 and in U.S. Pat. Nos. 3,698,882 and 3,736,233.

The prior art has taught the use of electric arc technology as well as plasma arc technology for gasifying products. The earliest known electric arc process for gasifying coal is disclosed in U.S. Pat. Nos. 1,249,151 and 1,282,445 to B. F. McKee. In Research and Development Report 34 entitled "Arc-Coal Process Development" submitted by Avco Corporation, Systems Division, Lowell, Mass. 01851, to the Department of Interior, Office of Coal Research, the devolatilization and partial gasification of coal is accomplished using a heat source provided by a rotating electric arc. Plasma arc technology has been used in the conversion of municipal and industrial refuse into useful solid, liquid and gaseous products and having as a primary object the reduction in physical weight and volume of the refuse. U.S. Pat. No. 3,779,182 teaches a refuse conversion system having a furnace chamber into which is introduced a volume of unsegregated refuse. The refuse is maintained in contact with the arc of a plasma generator so as to reduce the refuse to molten liquid and gaseous products by pyrolysis in the absence of a reactant gas in the reduction chamber. The refuse is effectively stacked and assumes various levels in a tiered array. Other prior art teaches gasifying tiered layers of coal.

U.S. Pat. No. 3,422,206 discloses an electric furnace having three side-mounted arc devices for melting discrete batches of metal. This patent recognizes that a specific angular relationship between the torches will impart angular momentum to the bath surface to produce a "stirring" effect. Neither the nature of this "stirring" nor its impact on the overall process is disclosed. A similar furnace construction using oxy-fuel burners is described in U.S. Pat. No. 3,459,867.

A process for rapidly decomposing coal using an electric arc as the heat source is described in U.S. Pat. No. 3,384,467. The coal is introduced at the base of the furnace by a screw feeder, and the coal itself carries the arc current. The coal is devolatilized in approximately three seconds with a coal energy absorption rate of approximately 600 Btu/lb-sec. The gas products of this process represent only 15 percent of the weight of the initial coal input. No reactant is introduced into the furnace, and the fixed carbon is not gasified.

Also to be noted is that various prior art processes require the vessel or the heat source to be rotated. Also, the coal or other matter being gasified is often required to be forced up vertically through a bed of material being gasified which requires heavy and sometimes complex feeds.

A study of the prior art indicates that there is an acute need for a reliable and efficient system and method for gasifying carbonaceous matter, especially coal, having the following characteristics: (1) The heating process is decoupled from the gasification process; (2) The system is adapted to release the volatiles and gasify the fixed carbon of coal on a continuous basis in one vessel; (3) The endothermic heat is supplied by efficient electrical means, vis: long arc column plasma torches; (4) Neither the plasma torch nor its vessel is rotated during gasification: (5) The furnace temperature can be relatively high and can be controlled principally by a single control, i.e., torch power; (6) The char has maximum surface area of exposure to accelerate the gasification reactions; (7) The char can be maintained in motion during gasification; (8) Any grade or type of coal may be devolatilized and gasified in the same chamber without extensive pretreatment such as washing, drying, fines removal or agglomeration; and (9) Gravity feed may be employed for the incoming coal.

The achieving of the foregoing characteristics in an integrated system and process thus becomes an object of this invention

SUMMARY OF THE INVENTION

The apparatus and method of the present invention serves to continuously convert solid coal or other carbonaceous matter into a fuel gas using a bank of long arc column plasma torches to provide the necessary heat mass. In a preferred embodiment, the torches are used to melt an electrically conductive material, e.g., scrap iron and/or steel, in a pool at the bottom of a refractory-lined furnace. The plasma arc columns maintain the refractory lining of the vessel at a temperature of approximately 1000° C. and after start-up the torches normally assume fixed positions. Coal is continuously introduced in measured quantities and in physically separate streams into the furnace vessel by substantially air-tight, gravity-fed rotary feeders. Devolatilization of the coal takes place at each entry site immediately upon introduction into the process vessel, converting the coal into a carbon-rich char that settles down onto the slag surface of the molten pool of metal held in the hearth of the vessel.

A predetermined amount of high pressure steam is simultaneously and continuously injected into the vessel and serves as a reactant to release the fixed carbon in the carbon-rich char. The injected steam is produced by utilizing the sensible heat of the produced raw gas and a portion of the exthothermic heat produced in the raw gas processing by the reactions in the shift reactor and methanator.

With the endothermic heat requirements supplied by convection and radiation from the plasma arc column and by conduction from the molten pool, the fixed carbon in the char reacts with the steam to form $CO_n$ radicals and hydrogen. The hydrogen in turn reacts with carbon to form methane. The plasma columns and steam injectors are preferably arranged so that a pair of cusping eddy currents are established on the slag adjacent each torch which induces a swirling motion in the various coal mounds at each one of the gasification sites and principally provides radiant heat.

The ash component of the char is fluidized by the molten slag as the char accumulates, thereby constantly increasing the slag level during gasification. The excess slag is removed from the furnace either continuously or at intervals and deposited into a water-sealed slag collector.

The raw gas from the furnace is processed through a gas cooling train where condensates and particulates are removed. Carbon dioxide and sulfur can also be removed. The clean product gas can then be burned as a medium Btu fuel gas or can be upgraded by conventional processes to a pipeline quality gas or otherwise used. Plural types of raw gases can also be produced.

DESCRIPTION OF THE DRAWINGS

FIG. 11 is a fragmentary, sectional view of the lower portion of the furnace unit taken substantially along line 4—4 of FIG. 2 and with a graph projected therefrom illustrating the temperature gradient from the upper surface of the slag to the outside of the furnace skin.

FIG. 12 is a front view of a control panel for one furnace unit.

FIG. 13 is a block diagram of an independent module having two furnaces and means for upgrading the raw gas to a pipeline quality gas, the plasma torches, power supply and coal supply not being shown for simplification of illustration.

DESCRIPTION OF THE PREFERRED EMBODIMENT

In broad application, the invention is adapted to gasify virtually any kind of carbonaceous matter, including sawdust, lignite biomass, plastics, tires, kerogen, bitumen and coal. Mixtures of these various types of carbonaceous materials may also be used providing that the fixed carbon content of the mixture is maintained relatively uniform. The preferred embodiment describes an apparatus and method for releasing the volatiles and gasifying the fixed carbon components of coal which normally represents relatively homogeneous, high energy density carbonaceous matter. Again, different varieties of coal may be processed together so long as the fixed carbon content of the mixture charged to the furnace remains substantially uniform during the processing operation. This is necessary since the operating conditions are selected on the basis of fixed carbon in the charge. With minor variations, and without departing from the scope of the invention, the preferred embodiment may be modified for the gasification of other carbonaceous matter.

Figure 1:
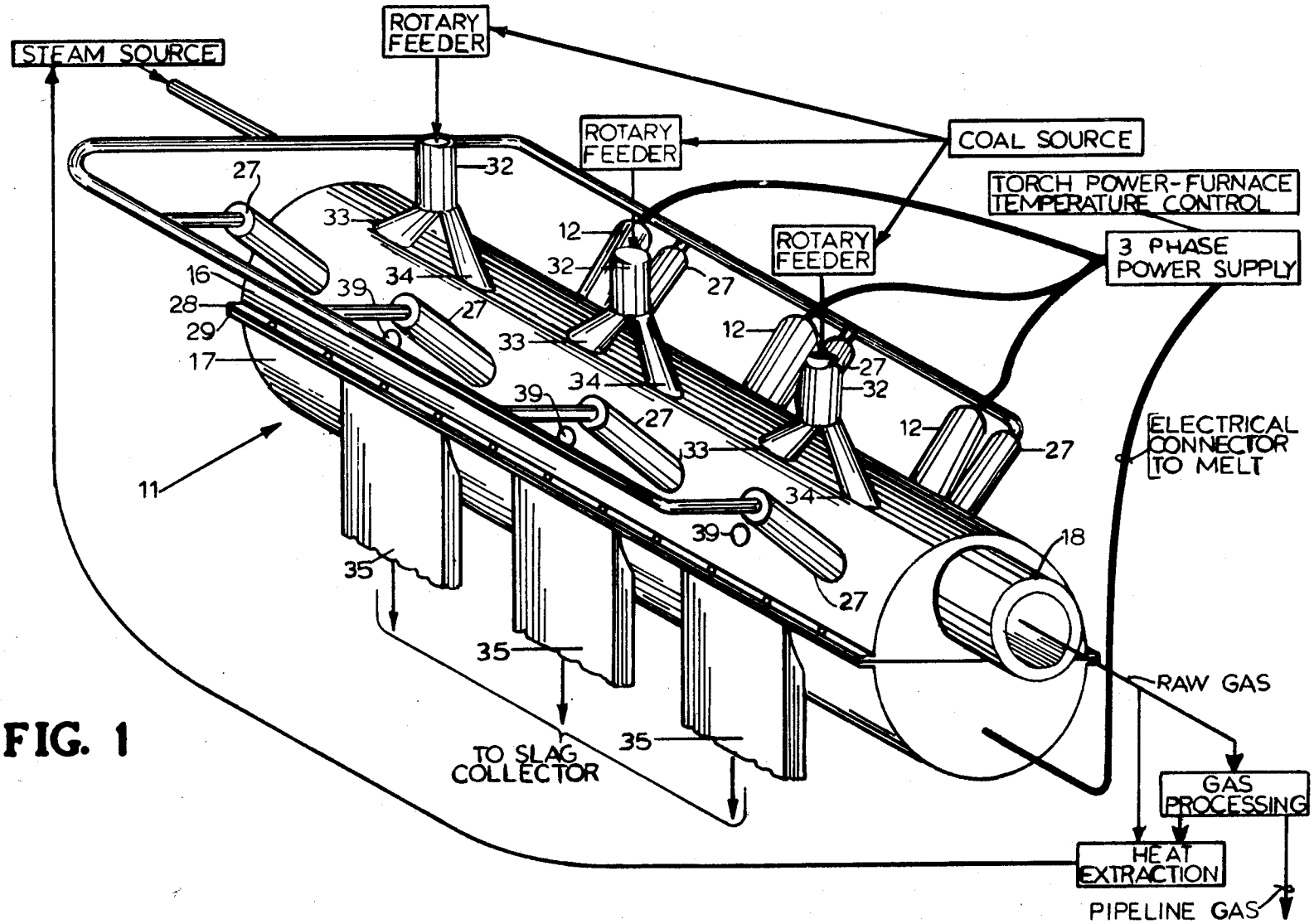
FIG. 1 is a perspective view of one furnace unit of the present invention and FIG. 1A is a schematic process illustration.
Figure 1A:
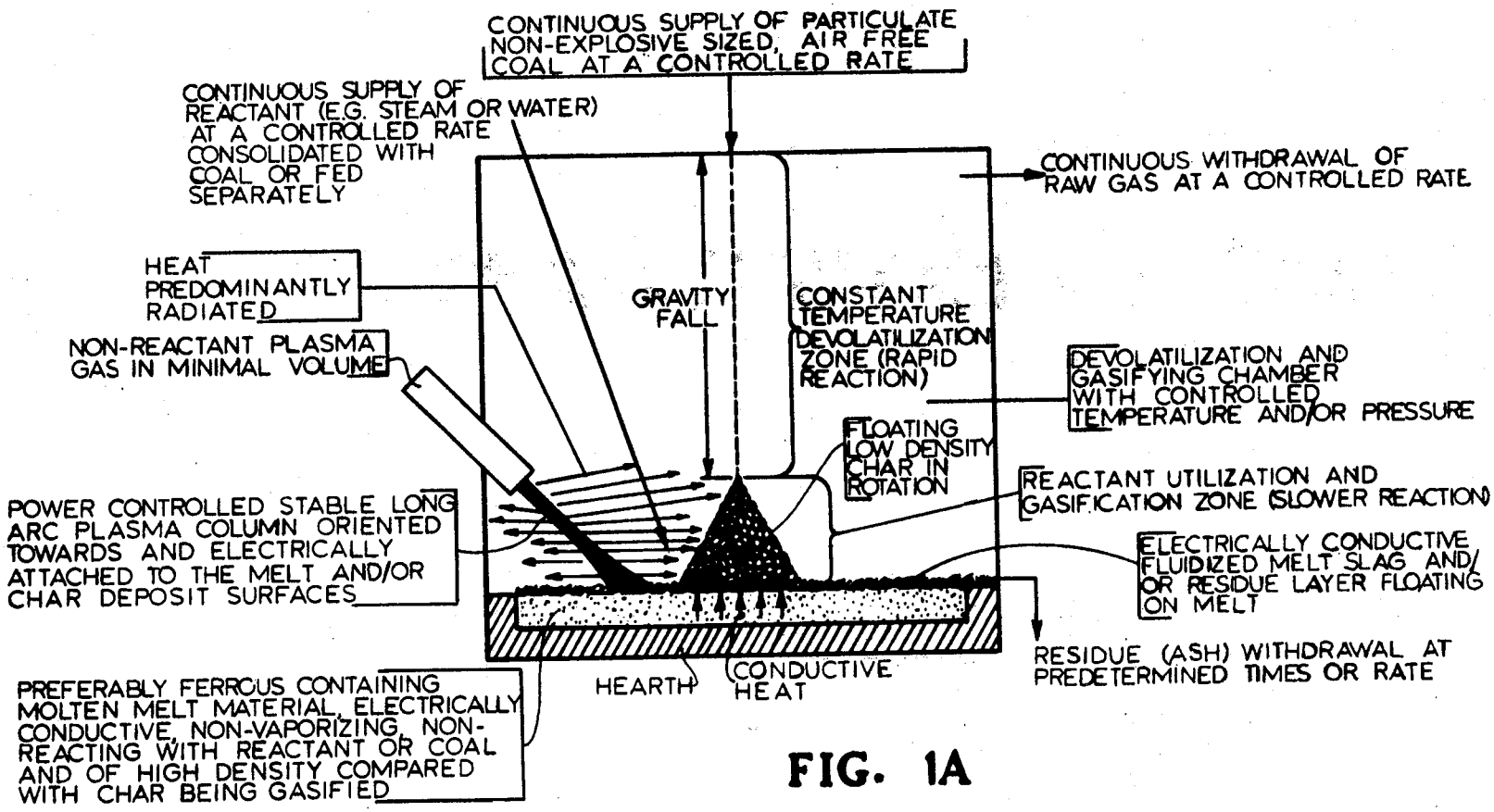
Figure 2:
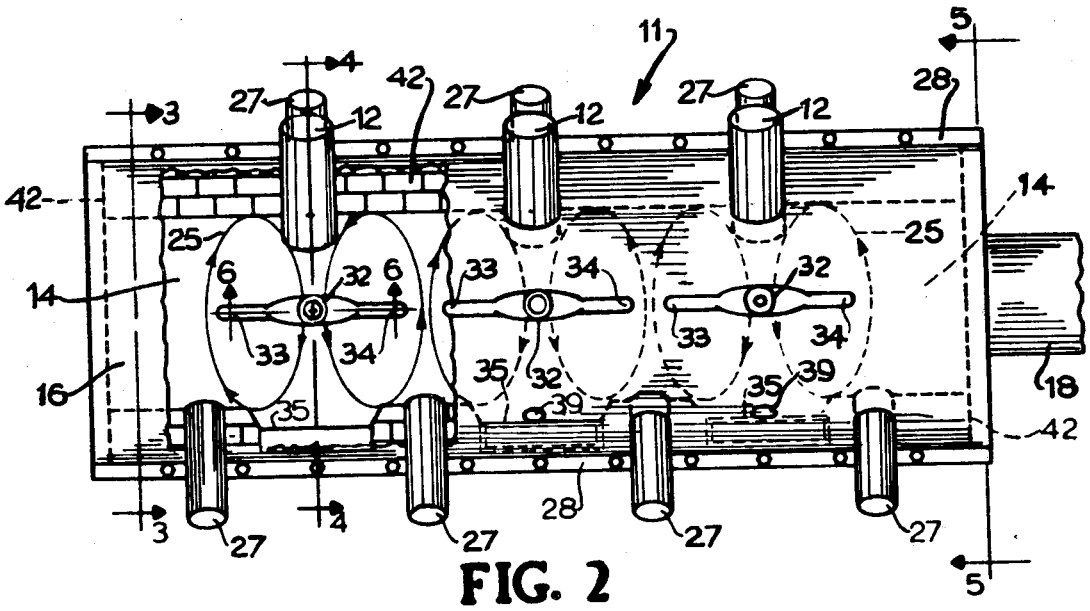
FIG. 2 is a plan view of the furnace unit with a portion of the furnace skin removed for purposes of illustration.
Figure 3:
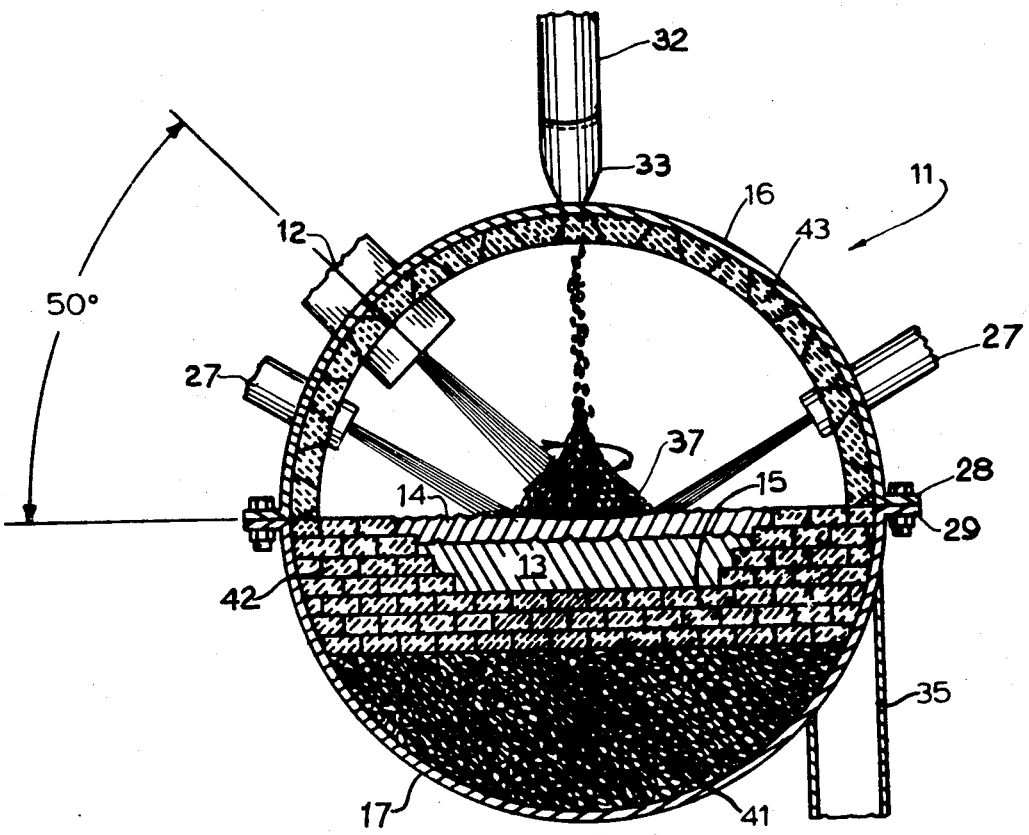
FIG. 3 is an enlarged section view of the furnace unit taken substantially along line 3—3 of FIG. 2.
Figure 4:
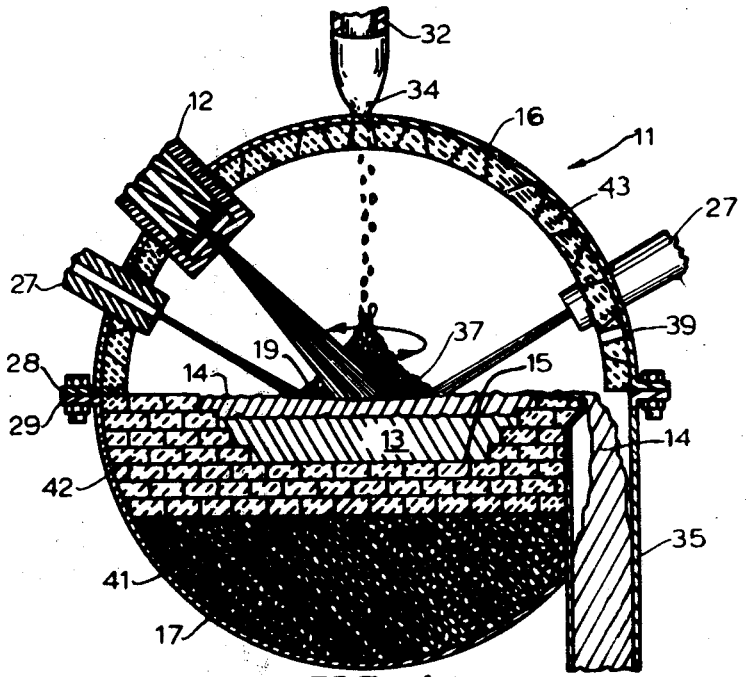
FIG. 4 is an enlarged section view of the furnace unit taken substantially along line 4—4 of FIG. 2.
Figure 5:
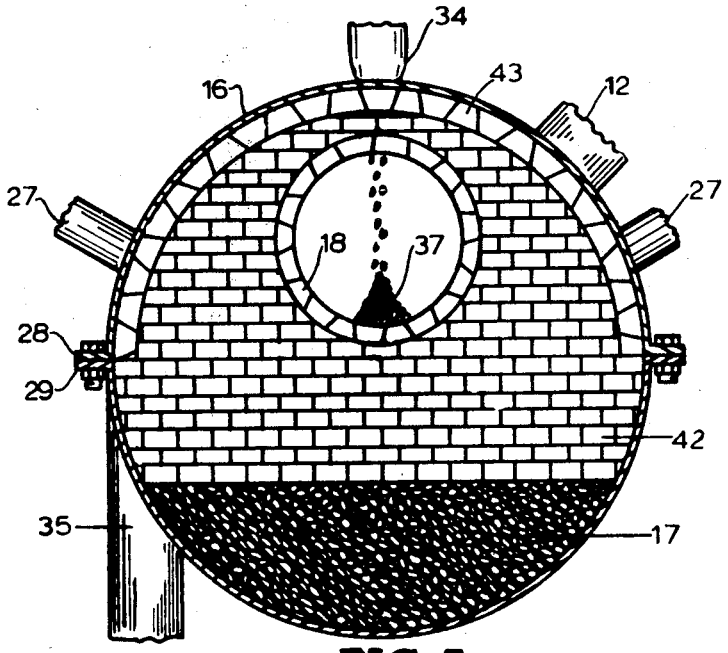
FIG. 5 is an enlarged elevation view of the gas exhaust end of the furnace unit with the metal skin removed for purposes of illustration and taken substantially along line 5—5 of FIG. 2.

Referring to the drawings, particularly FIGS. 1–7, the coal gasification system and method of the present invention, in a preferred embodiment, includes a hollow, cylindrical, refractory-lined vessel, identified as furnace 11, which serves to enclose the entering coal, the char, the reactant steam, the gases obtained during devolatilization and the gases produced during the gasification process. Furnace 11 comprises upper and lower cylinder half-sections 16, 17 having mating flange portions 28, 29 (FIG. 3). Sections 16, 17 are made from carbon steel material of suitable thickness. Along the entire length of the base of furnace 11 is a compacted refractory support plastic 41 which, in the preferred embodiment, is "Korundal" plastic material manufactured by Harbison-Walker, Inc., of Pittsburgh, Pa. A number of layers of refractory brick 42 are placed above compacted plastic and arranged within furnace 11 to form a hearth of pool 15. The inner surface of upper section 16 is lined with key-type refractory brick 43. A gas removal line 18 is connected to a mating opening in one end of furnace 11 (FIG. 5).

Three long are column plasma torches 12 extend through spaced openings in the wall of furnace 11 and are operated principally as radiant heat sources. Torches 12 are mounted for both slidable and pivotal movement. The torches normally operate at an angle of approximately 50 degrees from the horizontal but are adapted to pivot for slag removal as described later.

Wall-mounted slide and tilt mechanisms for plasma arc torches are well known and it should be noted here that such pivotal and axial adjustments are primarily used in starting and slag removal operations. During normal operation, the plasma torches are themselves held stationary at the mentioned angled positions.

Three steam injectors provide a "reactant" and are associated with each torch 12. The steam is produced as later discussed in reference to FIG. 13. One injector 27 is positioned immediately beneath each torch 12 so as to inject steam just below the plasma arc. Two other injectors 27 are positioned on the opposite side of furnace 11 from torch 12 and serve to inject steam on each side of the plasma arc. The adjacent torches 12, in the embodiment shown in FIG. 2, share the same intermediate injector 27 so that there are seven steam injectors 27 in furnace 11. Also associated with each torch 12 is a coal feeder conduit 32 for introducing plural streams of pulverized coal into furnace 11 from a supply hopper and rotary feeder (not shown). Conduit 32 is split into two lines 33, 34 for introducing coal on both sides of torch 12.

The assembly of furnace 11 begins by filling the lower furnace section 17 approximately one-half full of plastic 41 which is then tightly compacted by an air hammer, or the like. Then refractory brick 42 is laid on the surface of plastic 41 thereby forming a pool 15 along substantially the entire length of furnace 11. Before joining furnace sections 16 and 17 together, the inner surface of upper section 16 is lined with refractory bricks 43 which are locked in place in a manner similar to the locking in place of an arch using a keystone. Once refractory bricks 42 and 43 are in place and a mass of scrap iron and steel is positioned in pool 15, upper section 16 can be lifted over lower section 17 and the two sections secured in place along flanges 28, 29 by a plurality of bolts. Torches 12, coal feeder lines 33, 34 and steam injectors 27 are then inserted in position and the necessary supply services installed. The mentioned pool 15 is effectively the refractory-lined hearth of the vessel. The coal particle size, the length of the gravity fall to the hearth 15 during devolatilization and the overall heat transfer characteristics allow the coal to be devolatilized prior to depositing on the surface of the melt pool in a single level, non-tiered array. By comparison, U.S. Pat. No. 3,779,182 shows the material being operated on at various levels and effectively stacked or tiered.

Torches 12 convert electrical energy efficiently into radiant heat by plasma generation (not by combustion with its inherent products of combustion that dilute the product gas) and, therefore, serve as an ideal radiant heat source for the devolatilization and gasification of carbonaceous matter, especially coal. The heating process can thus be decoupled from the gasification process since torches 12 supply the entire endothermic heat requirements of the furnace without oxidation of a portion of the input coal. Therefore, a coal utilization can be achieved which is significantly higher than that found in the prior art. Also to be noted is that torches 12 allow a relatively high operating furnace temperature, e.g., 800° to 2000° C. or better, which sustantially increases the overall conversion and rates of conversion.

In the specific embodiment, each torch 12 is a long arc forming plasma torch of the type described in U.S. Pat. No. 3,818,174. Long arc column plasma torches have recently become well known in the art as having the capability of sustaining stabilized plasma arcs on the order of one meter in length. In contrast, conventional short arc plasma torches generally sustain arcs of less than 0.2 meter and typical non-plasma electric arc devices have no stabilizing character and produce relatively short arcs. The apparatus and method of the invention recognize and utilize features of the long arc torch which makes its stabilized, electrically conducting gas column especially suited for use with gasification of coal as a source of radiant heat and particularly when used in multiple and arranged as described with the "long arc" being at least 0.3 meter.

The invention recognizes that long arc torches such as the one described in U.S. Pat. No. 3,818,174 are designed to convert electrical energy to heat with an efficiency of approximately 90% as compared with an efficiency of 30–50% for conventional short arc torches. Further, it is recognized that the capability of the long arc torch to sustain longer arcs enables all but the tip of the long arc torch to be positioned outside of the furnace wall and away from the intense furnace heat produced during gasification. This advantage reduces the wear on the torch and increases the thermal efficiency of the process. It is also recognized that the long arc plasma column produced by a long arc torch is capable of imparting a substantial momentum to the surface of the melt for forming currents thereon at each of the plural gasification sites as described later. Also, the invention recognizes that the long arc torch requires significantly less current than a conventional torch thereby reducing the cost of electrical conductors and reducing the complexity of the electrical power connections. The torch of U.S. Pat. No. 3,818,174 is capable of maintaining an arc one meter long, for example, with a current of only 1000 amperes. With the torch arrangement of the invention, there is no need to rotate the arc, i.e., the plasma column, with respect to the furnace vessel thus eliminating the need for magnetic or other types of arc rotating mechanisms.

Hearth 15 holds a predetermined volume of conductive metal 13 which is preferably scrap iron and/or steel and which, before melting, may comprise a number of steel I-beams, for example. Since it is contemplated that the "melt" may be established by using molten materials other than scrap irons or steel, the desired character of the melt material should be noted. Such material should be electrically conductive; should melt into a flat bath at the operating temperature of the furnace; should operate to fluidize the char to be gasified as well as the ash to be drawn off; should have a relatively high density compared to the density of the char in order to float the char; should not itself react with the reactant, with the devolatilized gases or with the gases obtained during gasification; and should not vaporize at the furnace operating temperature. From the foregoing characteristics, it can be seen that the choice of melt material is in part determined by the choice of reactant, e.g., steam, water or ammonia, as well as by the choice of temperature which in turn is determined in part by the desired gas to be produced. Thus, some metals or salts other than scrap iron or steel could conceivably be employed as the melt. However, an iron containing melt offers an advantage because of the affinity of iron for pyritic sulfur when contained in the carbonaceous matter and the resulting ferrous sulfide will and may become part of the discarded residue.

The melt, of course, constitutes in effect a fluidized "electrode" furnace floor and such fluidity facilitates obtaining the mentioned characteristics. However, it is to be noted that with appropriate choices of reactant and raw gas to be produced and with appropriate ash removal, the electrode "floor" could also be formed of carbon brick and thus be non-fluid in nature. In this alternative arrangement there could still be the advantages of having a bank of long arc plasma torches, of operating from a common power supply, of using a common coal source and of being arranged so as to simultaneously gasify the coal at plural sites, as previously explained, preceded by devolatilization in the same vessel.

In order to initially heat furnace 11, the arc-sustaining end of each torch 12 is moved into close proximity to the surface of metal 13 by axial movement inwardly of each torch 12 so that metal 13 may serve as the external electrode for the plasma arc, connecting each torch electrically with the others. The arc may be initiated to metal 13 by use of a "pilot arc" according to the teachings of U.S. Pat. Nos. 3,818,174 and 3,779,182. In the preferred embodiment, all three torches 12 may be simultaneously started and the power may be supplied to the torches by use of a three-phase A.C. wye having a floating neutral and more particularly described in U.S. Pat. No. 3,779,182. Once the three arcs have been initially struck, the three torches 12 are withdrawn to their normal operating and normally fixed positions whereby three arcs having lengths of approximately one meter or more are sustained and whereby only the tips of the torches are exposed within furnace 11. Within a few hours, furnace 11 may be brought to operating temperature by the heat generated from the plasma arcs sustained between torches 12 and metal 13. The furnace operating temperature should be at least 800° C. with higher temperatures being limited solely by the capacity of the refractory materials to withstand them. As a practical matter, based on the present state of suitable refractory materials, the operating temperature will normally be in the range of from about 800° to 2000° C. A minimum temperature of 800° C. is required to effect a thermal cracking of the gases obtained during devolatilization. Such cracking is highly beneficial in that it yields short chain hydrocarbon gases and prevents condensation of the volatiles to produce tars. By "operating temperature" there is meant a stabilized temperature which is substantially uniform throughout the void space or chamber area above the melt pool contained in the hearth at the lower part of the furnace. Temperature stabilization and uniformity are achieved essentially by heat radiation from the interior surfaces of the furnace. The temperature is preferably measured and monitored at a point on the refractory lining near the top of the furnace by means of a thermocouple. Since the rate of gasification is a function of the operating temperature, the rate at which the carbonaceous feed is charged to the furnace is dependent upon and correlated with the selected operating temperature. The preferred operating temperature of the refractory lining within furnace 11 is approximately 1000° C. and the system is completely heated once this temperature can be maintained and a significant portion of metal 13 have been melted in order to provide a heat mass. As metal 13 becomes molten, the slagging material within the metal also melts and, being lighter than the molten iron, floats to the top of the molten iron to form a slag layer 14. Slag 14 consists essentially of iron oxides and inert materials found in iron and steel, such as silica. A thin layer of slag 14 will automatically form upon melting metal 13. However, a small quantity of lime, dolomite, or the like, may be initially placed in pool 15 to supplement the slagging material contained in the scrap iron or steel and during the gasification process the slag level will continuously increase as a result of the melting of the ash components of the coal. In order to maintain the ash fluidized and to facilitate removal, the slag layer is preferably maintained at a uniform thickness of ten to fifteen centimeters within the hearth.

A significant advantage of the apparatus and method of the invention resides in the fact that the coal mass is broken into plural streams and is operated on at plural sites and while the individual plural mounds of coal are kept in motion. In this regard, the particular configuration of furnace 11 is specifically designed for a typical localized surface temperature of 1300° to 1800° C. on the slag, advantage is taken of the fact that a pair of elliptical cusping eddy currents 25 will form on the surface of slag 14 on the sides of each long arc plasma column. Eddy currents 25 are created and continuously maintained by the dynamic pressure imposed on the surface of slag 14 by the long arc plasma columns. Such pressure imparts a substantial momentum to slag 14 and causes a small depression 19 to form on the surface of slag 14 at each point of arc contact, i.e., at each gasification site. This effect is analogous to the eddy currents which can be formed on the surface of water in a glass by blowing a small diameter stream of air onto the water surface at an angle off the vertical. In order to achieve currents 25 having maximum vortex strength, it has been found desirable to have the plasma long arc column strike the melt surface, i.e., slag 14, at an angle of approximately 30° to 60° from the horizontal, and preferably at 50° at each of the gasification sites.

Once the operating temperature has been reached and a layer of slag has formed, crushed coal can be continuously fed into furnace 11 in plural streams through plural rotary feeders which are positioned at the top of furnace 11 over each respective torch 12. In the specific embodiment, the rotary feeders are air-tight, gravity-fed rotary feeders of the paddle wheel type manufactured by the Fuller Company of Manheim, Pa. which allow the coal to be introduced with a minimum introduction of air. It is important that atmospheric air be excluded from the system to the extent possible since the oxygen component reacts with carbon to form carbon dioxide of negligible value as a fuel gas and the nitrogen component causes a dilution of the desired product gases. Pulverized coal from each rotary feeder travels through a respective conduit 32 and through respective bifurcated lines 33, 34 for each torch position in order to deposit the coal in a "waterfall" effect on both sides of each torch 12 and so as to establish plural operational sites and maximum exposed area of coal during devolatilization and gasification. It is necessary that the coal, or any other carbonaceous material which is processed, be in a particular form and that the particle size not exceed ¾ inch. In terms of mesh, a size of 30 mesh is suitable or "Buckwheat No. 1," which is a size known in the coal industry. As a general rule, the larger particle sizes will require more residence time and more energy for gasification. Regardless of the size of the coal particles being introduced, the coal does not have to undergo any pretreatment such as fines removal, agglomeration, drying, washing, etc., and may be supplied from an overhead supply.

The input coal has three essential components: volatiles, fixed carbon and ash. The combination of fixed carbon and ash, which remains after devolatilization of the coal, will be referred to as "char". As the input coal falls into furnace 11 in the various plural streams, it is devolatilized in a matter of milliseconds and the remaining char settles in a single level, non-tiered array and floats on the slag surface in mounds 37 preferably within the system of eddy currents 25 at each respective torch site. The char is thus caused to swirl by the currents 25 so as to form the mounds 37 of char floating and rotating on slag 14 within each eddy current 25. At times, the arc may attach to the char itself as the electrode. However, the arrangement illustrated allows the incoming coal to fall over a sufficient predetermined distance to be devolatilized during its fall thereby eliminating any tendency for the arc to attach to the incoming coal as with some electric arc gasification systems.

In order to optimize the percentage of carbon contained in the coal which is converted to useful gas (i.e., to optimize coal utilization), a suitable carbon-combining reactant must be introduced into the furnace during the process. That is, such reactant must contain a chemical element that will combine with the carbon in the char to produce a raw gas of desired composition. It is contemplated that the preferred reactant will contain hydrogen since the raw gas desired is normally a hydrocarbon. Water and steam are considered preferred reactants because of their ready availability and relatively low cost. Ammonia represents another possible reactant but introduces the problem of disposing of the nitrogen that would be produced during gasification. Also, to be noted is the fact that while the primary purpose of the apparatus and method of the invention is that of achieving coal gasification, useful coke would be produced in the absence of any reactant and such coke could be removed by appropriate rake removal apparatus.

Pure hydrogen gas would be the most ideal reactant; however, cost generally prohibits its use. In the preferred embodiment, steam is injected into the furnace as a reactant through steam injectors 27. It should be noted that the steam from injectors 27 strikes the surface of the melt, i.e., slag 14, so as to reinforce each eddy current 25 at the point directly below the plasma arc column and at the remote boundary of the eddy current 25. As described later, the steam is produced in a steam generator using the sensible energy of the raw gas produced by the process and using the sensible heat from the exothermic reactions which take place during the upgrading of the Btu content of the gas. The amount of steam required and which is injected into furnace 11 depends upon the stoichiometry of the particular operation. That is, a stoichiometric amount is used which depends on the amount of coal and its fixed carbon content. Tests indicate that the injection of 0.3–0.5 ton of steam per ton of coal will generally supply enough reactant to sustain the process under typical processing conditions.

The swirling mounds of char 37 which should preferably tend to locate within each eddy current 25 are continuously heated by conduction, convection and radiation so that the fixed carbon in the char, within a residence time of five to thirty minutes, is reacted with steam to form fuel gases consisting mainly of $CO_n$ radicals and hydrogen, according to the following stoichiometric equations:

$$C+H_2O \rightarrow CO+H_2 \quad (1)$$

$$C+2H_2O \rightarrow CO_2+2H_2 \quad (2)$$

These two reactions are endothermic and receive both direct and indirect heat from the torches 12, directly by radiative and convective heat transfer from the long arc plasma columns through the molten pool of metal and slag by conduction. With hydrogen present in the reaction chamber from the above reactions, methane can be formed via the stoichiometric equation:

$$C+2H_2 \rightarrow CH_4 \quad (3)$$

This reaction is exothermic and the resulting heat reduces the amount of energy required to sustain the reactions. This methane adds to the methane gas released during devolatilization.

Figure 6:
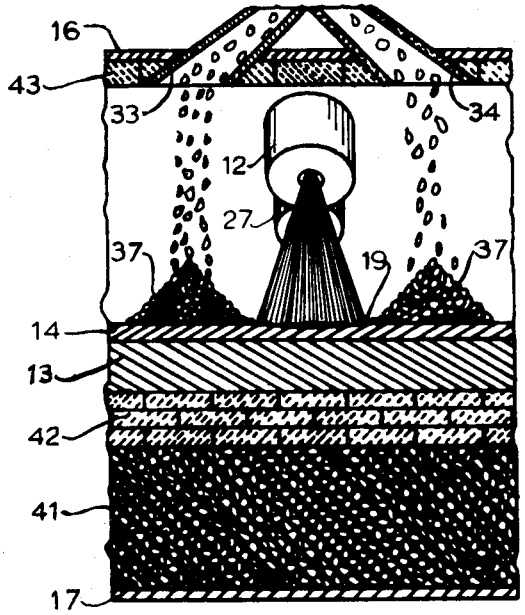
FIG. 6 is an enlarged section view of a portion of the furnace unit taken substantially along line 6—6 of FIG. 2.
Figure 9:
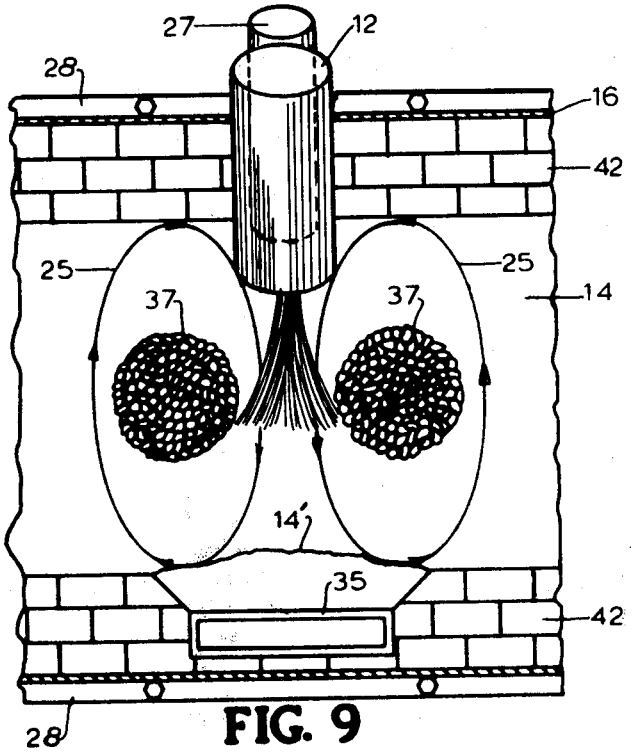
FIG. 9 is an enlarged, fragmentary plan view of the eddy currents formed by one plasma torch during normal operation of the furnace unit.

With reference to FIGS. 6 and 9, the movement of the char on the melt surface, i.e., on slag 14, and the heat transfer from torches 12 which is primarily radiated heat was well as the characteristics of furnace 11 will next be described in detail. A large portion of the fixed carbon in each mound 37 is gasified along the interface between the char and slag 14 with the heat requirement being supplied primarily by conductive heat transfer at the interface. The remainder of the fixed carbon is gasified along the surfaces of each mound 37 with the aid of radiated and convected heat from the plasma arc. As the fixed carbon is gasified, a fluid glass-like substance (molten ash) is left behind. As previously mentioned, this molten ash eventually settles to become a part of the fluid slag layer. It is imperative that the molten ash deposit remain fluidized and not be allowed to freeze on the surface of mound 37 and thereby form a frozen glass-like surface which would shield the inner char from the radiated and convected heat and from the steam. The radiation flux between the plasma flame and mound 37 assures that such a frozen surface does not hamper the gasification process. The plasma column can be expected to exhibit a temperature along its centerline of approximately 8000° C. The positioning of each long arc plasma column and the size and proximity of each char mound 37 with respect to each plasma column should preferably be such that the radiation flux between the plasma column and mound 37 will cause a localized temperature of approximately 1800° C. to 2300° C. to be maintained along the surface of mound 37 nearest the plasma column. The temperature of this surface when so maintained serves to melt any frozen glass-like layer which may otherwise form on the surface of mound 37. Each mound 37 is preferably so formed and located so as to be continuously rotating within its eddy currents 25 and such that the entire surface of mound 37 will be exposed to this radiation flux according to such rotation. The column may sometime attach to mound 37.

It should be noted that the particular construction and operation of furnace 11 enables the coal to be gasified in a reaction that is relatively slow compared to the rapid devolatilization reaction. Such gasification is effected in a gasification zone in a plurality of char deposits (mounds 37) which rest on the surface of slag 14 at corresponding plural gasification sites and which are independently movable thereon. This feature of the invention in conjunction with the introduction of the coal in plural streams has the advantage of allowing a large percentage of the char to be directly exposed to conductive, convective and radiative heat transfer because of the large exposed surface area. It has been found that the optimum gasification of fixed carbon is achieved when the maximum surface area is exposed to heat obtained from either the heated atmosphere or the slag surface. Virtually all of the gasification reactions take place on the exposed surfaces where the fixed carbon molecules can physically contact the reactant molecules. While it has been a primary object of all known coal gasification processes to expose a maximum percentage of the char to the reactant gases, it is believed that the apparatus and method of the present invention provide the simplest and most reliable means for meeting this objective. Note should be taken that the char is introduced onto the melt surface in a plurality of deposits, thereby assuring a higher surface area exposure per unit mass than if only one deposit were used. Furthermore, the char deposits are kept in motion by the slag currents; therefore, the char deposits are being continuously rearranged and positioned from heat protected to heat exposed positions and so that a glass-like coating of solidified ash will not form on the deposits.

Figure 10:
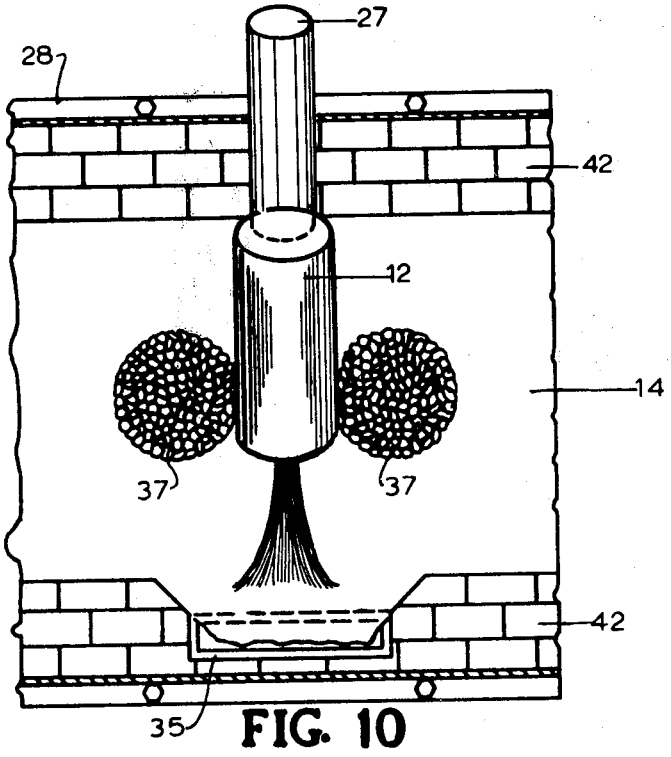
FIG. 10 is a view similar to FIG. 9 showing the plasma torch in the position the torch takes during periodic slag removal.

During the gasification process there is a continuous accumulation of slag 14 due to the molten ash which is left behind after gasification of the fixed carbon. Therefore, a slag removal system is required to maintain the thickness of the slag layer within limits. In the preferred embodiment, a slag removal chute 35 is located opposite each torch 12. Chute 35 leads to a watersealed slag collector (not shown). Chute 35 has an inlet opening located at a height just below the desired level to be maintained by slag 14. As best illustrated in FIG. 9, during normal operation an area of frozen slag 14' is maintained between the plasma column and chute 35. Periodically torch 12 may be tilted and further inserted into furnace 11 so as to cut a drainage path through the frozen slag so that excess slag can flow down chute 35 (FIG. 10). When the furnace temperature is maintained sufficiently high, the slag adjacent chute 35 may be kept in a molten state. In this case, the excess molten slag may continuously drain into chute 35 as it accumulates without cutting a drainage path. Thus, the occasional tilting and further insertion of torch 12 is made necessary primarily when slag freezes between the plasma column and chute 35.

A primary advantage of the molten metal and slag process is its ability to capture sulfur within the slag, thereby reducing the amount of sulfur in the raw gas. An electrically conductive molten salt (e.g., $NaCO_3$) would not provide this function. It is well known that sulfur in coal exists as organic sulfur and pyritic sulfur in roughly equal portions. Because of the affinity of iron for pyritic sulfur, the pyritic sulfur is essentially trapped within the slag layer and, therefore, does not form hydrogen sulfide as a portion of the raw gas. The uncombined organic sulfur will, of course, leave the furnace as a component of the raw gas in the form of sulfur dioxide. The total amount of sulfur entering the raw gas should be expected to be significantly less than that of conventional coal gasification processes. Further, the iron content of the melt can be periodically replenished simply by introducing powdered iron or scrap iron containing metal chunks with the coal.

Referring to FIG. 13, furnaces 11 are arranged in pairs to form independent modules 40. Each module 40 includes a pair of furnaces 11 and has its own gas cooler 20, $CO_2$ remover and steam condenser 21, sulfur remover 22, shift reactor 23, methanator 24 and steam generator 26. The gas cooler 20 receives the raw gas from two furnaces 11 and passes the gas along until it has been upgraded to pipeline quality by conventional means. Steam generator 26 serves to produce the steam which is introduced into furnaces 11 through steam injectors 27. The heat necessary to operate steam generator 26 is supplied by the sensible heat of the raw gas which is recovered in gas cooler 20 and by the heat which is given off by the exothermic reactions taking place in shift reactor 23 and methanator 24.

Each module with such a furnace pair can be designed so as to be capable of gasifying approximately 40 metric tons of coal per hour. In such a design, the module is capable of generating up to 80,000–100,000 standard cubic feet of raw gas per metric ton of coal. As illustrated in later examples, the raw gas leaving the two furnaces 11 can be, for example, a medium-Btu gas having a heating value of approximately 430 Btu per standard cubic foot. This raw gas may be utilized in numerous ways including the following: (1) upgraded to pipeline gas, (2) burned as a medium-Btu gas, and (3) used as a reductant gas for direct ore reduction.

In the specific embodiment, the six torches of the module can be designed so as to provide approximately 1500–2000 KWH excluding process losses to gasify one metric ton of input coal. The input coal is preferably selected so that it will pass through a screen having a mesh between 80 and 200. With a coal of 10,000 Btu per pound, the stated electrical energy requirement would represent approximately 20–25 percent of the calorific energy in the raw gas produced by the process. In a specific embodiment, furnace 11 is approximately six meters long and has an internal diameter of 2.5 meters. The three torches 12 in each furnace 11 are spaced approximately two meters apart. With appropriate choice of torch and positioning, it becomes possible to establish eddy currents 25 which measure 0.7 meters approximately across their minor axes. The velocity of the eddy currents 25 at their peripheries, when of such size, is estimated to be approximately ten centimeters per second. Also, with a furnace of these dimensions and by proper choice of coal size, operating temperature and other heat transfer conditions, the coal can be gravity fed and devolatilized continuously during its gravity fall.

Referring to FIG. 11, a cross-section of the lower portion of furnace 11 is shown as taken through line 4—4 of FIG. 2 which is coplanar with the longitudinal axis of one of torches 12. The graph accompanying FIG. 11 is referred to for giving a general indication of the temperatures within furnace 11. The localized temperataure at point A on the surface of the melt, i.e., slag 14, where the plasma arc strikes is approximately 1800° C. At point B where slag 14 meets metal 13 approximately 10 to 15 centimeters below point A, the temperature is approximately 1500° C. Point C represents the interface between bricks 42 and plastic 41 where the temperature is approximately 800° C. The temperature at the outer surface of the furnace skin, represented as point D, is approximately 125° C.

The furnace of the present invention can be operated at a low pressure, even at atmospheric pressure (1 $kg/cm^2$). This low pressure operation eliminates very costly and complex pressure regulators and safety apparatus required for some prior art systems. Furthermore, the complexity of apparatus for solids feeding and withdrawal is greatly reduced due to the low pressure operation. It has been determined that although operation at atmospheric pressure is acceptable, the percentage of methane in the raw gas increases with increased pressure. That is, a noticeable increase in methane production occurs at a pressure as low as 2 $kg/cm^2$ and increases with a pressure rise up to about 100 kg/cm$^2$. However, because of mechanical problems associated with seals, etc., in holding pressures at very high levels, the use of low pressures is more practical. When the raw gas is to be converted to a pipeline gas consisting essentially of methane, an ideal pressure for operation of the system is approximately 3 kg/cm$^2$ which, by comparison to many other systems, is a low and safe operating pressure. This pressure can be realized by controlling the rate at which product gases are withdrawn. The gas after methanation can be compressed to 600–1200 psig for delivery into existing pipelines.

As previously mentioned, the furnace control may be maintained by adjusting the torch power in response to fluctuations in a representative, sensed temperature within the furnace. This representative temperature is preferably monitored at a point on the refractory lining near the top of the furnace. The temperature is indicative of the energy which is being supplied to the input coal. The temperature may be maintained within limits by controlling the power supplied to the torches in response to temperature fluctuations. In order to maintain the temperature at a selected point, the power to the torch is increased when the coal input increases or when the nature of the coal is such that more energy is required to gasify it (e.g., when the input coal contains more moisture or more ash). Regardless of the coal input rate, the control temperature is essentially the only condition inside the furnace which must be monitored once appropriate conditions have been determined for a particular raw gas to be obtained from a particular coal. If the coal rate increases, this temperature will immediately decrease due to the energy absorbed by the coal, and in response more power can be supplied to the torches under either manual or automatic control. The steam injection rate is made directly proportional to the rate of coal input. An instrument panel for a furnace is shown in FIG. 12. The panel displays the representative temperatures sensed on the refractory lining and the flow rates of the input coal, steam and raw gas. The power, voltage and current demands of each of the three-phase torches are also displayed. Pressure is observed both as a safety precaution and also to relate the optimum pressure to a particular coal gasification process. One torch and its temperature can be the control.

In operation, the start-up of a furnace 11 is achieved by striking and continuously maintaining a plasma arc between each of the three torches 12 and metal 13 in the manner taught by U.S. Pat. Nos. 3,818,174 and 3,779,182. Once a significant portion of metal 13 is melted, a pair of elliptical cusping eddy currents 25 should be expected to form on the surface of slag 14 on both sides of each torch 12 at each of the plural gasification sites. After a temperature of approximately 1,000° C. on the refractory lining and a pressure of approximately 3 kg/cm$^2$ are reached and maintained, pulverized coal is introduced through the top of each furnace 11 in plural streams by means of the rotary feeders (FIG. 1). A pressure regulator, not shown, may be employed.

The volatiles in the input coal are immediately released in the top one-half of the furnace even prior to reaching the slag surface, and the remaining char deposits onto the slag within the paths of eddy currents 25. During a residence time of five to thirty minutes, the fixed carbon in the char is gasified in the presence of steam from injectors 27. As used herein, the term "residence time" means the estimated time demanded by the gasification reactions to be initiated and completed with respect to an identifiable unit of char. The height of the char at such site can be periodically observed through appropriate view ports 39. It is important to note here that the quantity and configuration of the char deposits need to be controlled so that the unoccupied volume and free surface area of the furnace are maintained substantially larger than the combined volume and surface area of the deposits. The raw gas is continuously removed from each furnace 11 and passes through gas cooler 20, carbon dioxide remover and steam condenser 21, sulfur remover 22, shift reactor 23, and methanator 24. Excess slag is removed as it accumulates, either continuously or at intervals. The operating temperature within each furnace 11 is carefully monitored so that the power to the torches 12 within each furnace can be adjusted to maintain a constant process temperature. The operation can be carried out on a continuous basis for long periods of time. After occasional shut-downs, the start-up of the process takes only a few hours as opposed to the approximately three-day start-up time required by conventional processes utilizing coal oxidation for heat.

EXAMPLE 1

A sample of Joyce Western No. 1 coal in approximately 80 mesh size was gasified in a long arc plasma torch simulator at 835° C., 40 psig and reacted with steam using about 0.4 pound steam per pound of coal. The raw gas from this experiment after the excess steam was condensed out had a calorific heat content of 428 Btu/SCF. An analysis of the gas showed: $H_2$, 47.8%; CO, 9.8%; $CH_4$, 16.4%; $CO_2$, 13.8%; $C_2H_2$, 2.0%; $C_2H_6$, 1.0%; Illuminants ($C_xH_y$) 2.2%; and $O_2$, 2.4%. The raw gas produced at this temperature and pressure has a high methane content and is an ideal gas for being upgraded to pipeline quality.

EXAMPLE 2

A sample of Joyce Western No. 1 coal in approximately 80 mesh size was gasified in a long arc plasma torch simulator at 1000° C. at atmospheric pressure and reacted with steam using about 0.4 pound of steam per pound of coal. The raw gas from this experiment after having the excess steam condensed out had a calorific heat content of 328 Btu/SCF. An analysis of the gas showed: $H_2$, 75.5%; CO, 13.4%; $CH_4$, 2.0%; $CO_2$, 7.6%; $C_2H_2$, 0.3%; $C_2H_6$, 0.1%; Illuminants, 0; and $O_2$, 2.0%. This raw gas is ideal for use as the reactant gas in the direct reduction of iron ore. By reacting this gas with iron ore, the ore can be beneficiated from approximately 50–60% iron to approximately 98% iron.

It should be noted that by varying certain parameters such as temperature, pressure and steam flow, the content of the raw gas may be controlled so as to be appropriate for a number of different end uses. For example, the experiment of Example 1 was conducted to produce a raw gas having a high methane content for conversion to pipeline gas according to the process illustrated in FIG. 13. In contrast, the raw gas of Example 2 has a low methane content and is best suited for other uses. It is important to realize that the raw gas of Example 2 is more than three-fourths hydrogen gas which has a calorific heating value of approximately 330 Btu/SCF. Thus, the apparatus and method of the invention can be used essentially as a hydrogen generator by separating the hydrogen gas from the other components of the raw gas. It is well known in the art that hydrogen may be a vitally important energy source in the future. The gases remaining after hydrogen separation have a high Btu content and may be directly burned or converted to a pipeline gas. It can be seen that by adjusting the furnace operating parameters, the gasification process may be controlled to emphasize the production of various components in the raw gas such as methane, hydrogen, acetylene, etc. Furthermore, as later described in reference to FIGS. 14, 15 and 15A, plural furnaces or compartments can be operated from common coal, reactant and power supplies and with individual furnace controls to produce plural raw gases to be processed or in a "cascade" array in which one gas beneficiates a succeeding gas.

Figure 7:
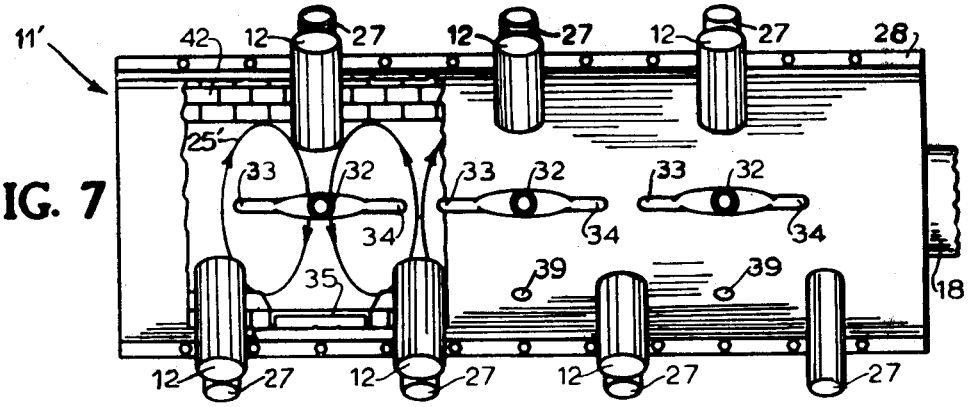
FIG. 7 is a plan view of a furnace unit of an alternative embodiment having six torches per furnace.
Figure 8:
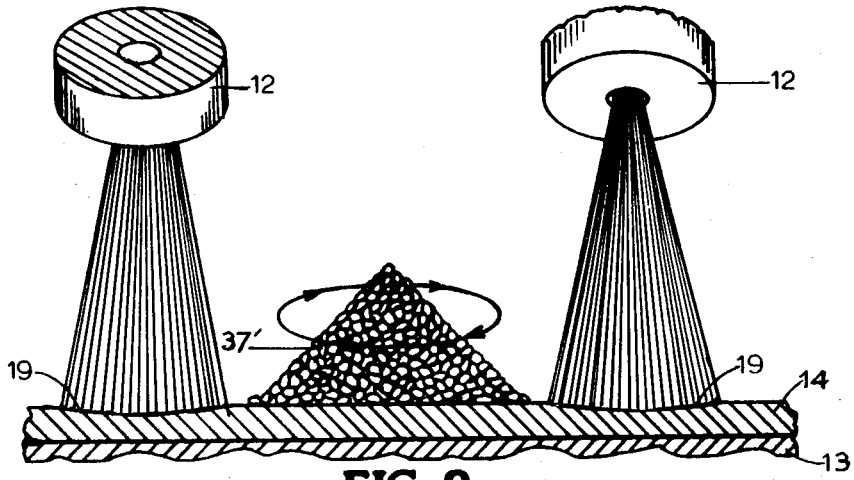
FIG. 8 is an enlarged side view of a mound of coal within the alternative embodiment illustrated in FIG. 7.

An alternative embodiment of the furnace unit is illustrated in FIGS. 7 and 8. Furnace 11' is similar in construction to furnace 11 of the preferred embodiment except that there are six plasma torches, three on each side. The torches 12 are positioned so that there is a torch to reinforce the elliptical eddy currents 25' on each side of the eddy currents 25'. This embodiment has the advantage of imparting more momentum to the surface of slag 14, thereby increasing the vortex strength of the eddy currents. Because of the increased eddy current effect on slag 14 and the increased power input available, the capacity of furnace 11' can be designed so as to be approximately twice that of furnace 11 of the preferred embodiment. Furnace 11' can, of course, be scaled to a size greater than that of furnace 11. Another advantage of furnace 11' is that the mound 37' within each eddy current 25' is subjected to radiation flux from two plasma columns as mound 37' rotates (FIG. 8). Thus, any frozen glass-like ash on the surface of mound 37' can be melted by exposure to two plasma columns during each rotation of the mound.

Figure 14:
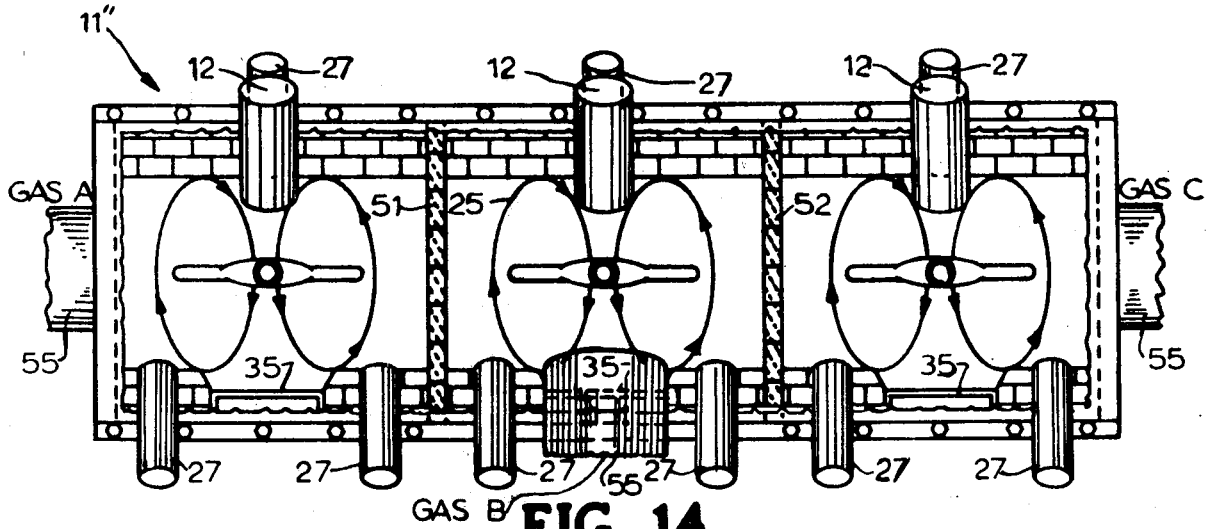
FIG. 14 is a plan view of an alternative embodiment furnace having three gasification compartments capable of producing the same or three separate gases utilizing a common melt to support the coal being gasified and with a portion of the top broken away and the coal feeder mechanisms removed to aid in illustration.

A second alternative embodiment of the furnace unit is illustrated in FIG. 14. Furnace 11'' is divided into three compartments by refractory-brick partitions 51, 52. Each compartment has its own torch 12, removal line 55, slag removal chute 35 and three steam injectors 27. Furnace 11'' is designed so that the three torches may be electrically connected by a common molten pool, thereby enabling the torches to be powered by a three phase power supply. Partitions 51, 52 allow the raw gases produced in each compartment to be physically isolated and to be separately removed by means of the three removal lines 55. Walls 51, 52 for this purpose should preferably be constructed so that the lower extremity of each wall 51, 52 extends below the level of slag layer 14 (FIG. 3) sufficiently to provide a gas barrier between each of the three compartments of FIG. 14 while at the same time allowing the melt to serve as a continuous conduction means for electrically connecting the three torches. A principal advantage of furnace 11'' is that it provides means for emphasizing the production of different raw gases in each of the compartments. For example, the operating conditions in the compartments may be separately controlled and maintained so as to maximize the production of methane, gas A, in one compartment, maximize hydrogen production in a second compartment, gas B, and maximize acetylene production, gas C, in the third compartment.

Figures 15, 15A:
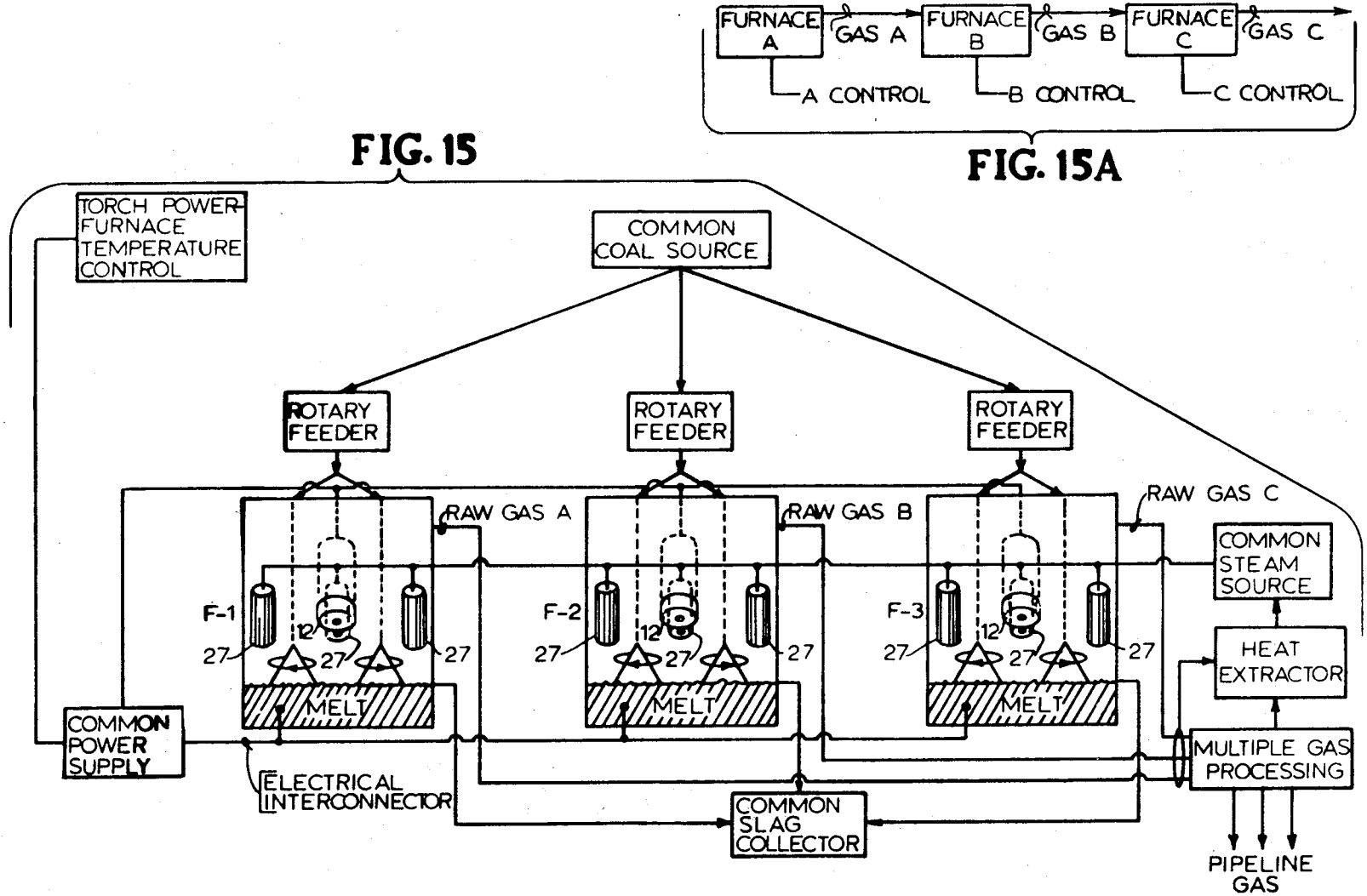
FIG. 15 is a schematic diagram of another plural furnace system and method in which plural gasification compartments utilize separate but electrically connected melts to support the coal during gasification, FIG. 15A being an alternative arrangement.

Among the advantages of the system and method of the invention is the fact that a common coal source can supply separately controlled plural coal streams to serve plural gasification compartments; that a common power supply can be employed for a plurality of long arc column plasma torches operating at a plurality of sites; that a common steam source can be employed for providing a reactant to a plurality of long arc column plasma torches at a plurality of operational sites. As previously noted, such common supplies of coal, power and steam can be used to produce either one or a plurality of types of raw gases. In FIG. 15 there is further illustrated, in schematic diagram form a system and method according to the invention in which three separate furnaces F1, F2 and F3 are operated with common coal power and steam supplies but with physically separate and electrically interconnected melts. With the apparatus of FIG. 15, a plurality of gases, designated A, B and C can thus be obtained with the melt characteristics chosen for the particular gas to be generated in the particular furnace. Alternatively, as indicated in FIG. 15A, the furnaces can be arranged with individual coal, steam and power controls and be cascaded so that gas A (e.g., principally hydrogen) beneficiates gas B (e.g., principally methane) and gas B beneficiates the desired raw gas C.

Figure 16:
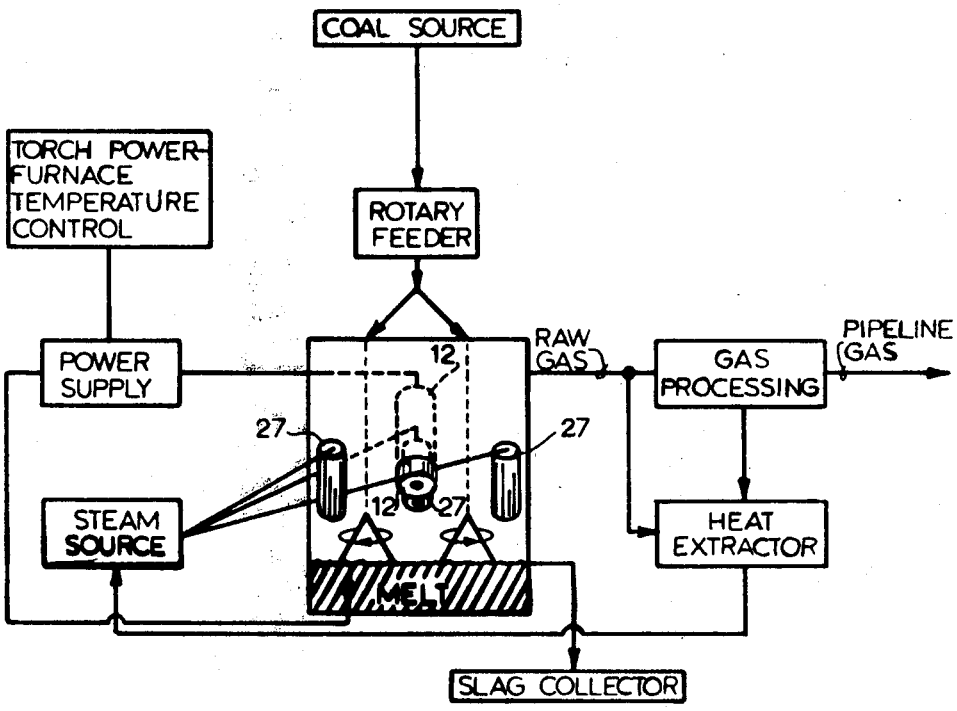
FIG. 16 is a schematic diagram of a single furnace system utilizing the apparatus and method of the invention.

While it is contemplated that in the majority of applications of the invention there will be a plurality of long arc column plasma torches, FIG. 16 illustrates in schematic form an apparatus utilizing a single torch but with plural coal streams in the coal feed and employing plural rotating char mounds at plural operational sites as previously explained.

Figure 17:
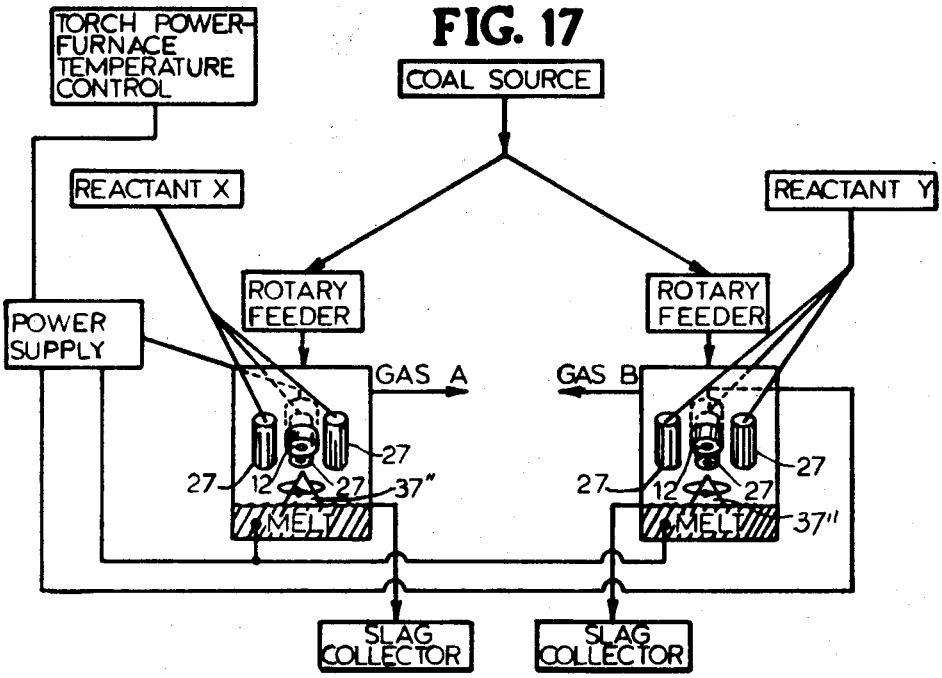
FIG. 17 schematically illustrates a further embodiment utilizing a common power and coal supply with different reactants to produce plural type gases.

In FIG. 17, there is a schematic representation of a coal gasification system according to the invention in which a common coal source feeds plural coal streams at operational sites having single char mounds 37'' and utilizes a bank of long arc plasma column torches 12 operated from a common power supply but with separate reactants, designated "Reactant X" and "Reactant Y". For example, "Reactant X" might be steam as previously described whereas "Reactant Y" might be ammonia or water depending on the raw gas desired. Pressure can be monitored and controlled if required.

The apparatus and method of the present invention provides numerous advantages over prior art practices and which include:

(A) The operating controls are greatly simplified. Unlike the prior art processes which must vary the feed rates of air, oxygen, steam and/or coal in order to compensate for any variations in the coal or other operating conditions, the system of the invention will normally require only an increase or decrease in the power applied to the torches to compensate for normal variations once the procedure has stabilized. The torches are easily adaptable to closed-loop automatic power control which is responsive to variations in a selected, representative temperature within the furnace. The obvious result is the elimination of costly and sophisticated process control systems which are necessary to maintain an optimum heat balance in the prior art processes.

(B) The long arc plasma torches provide extremely high localized temperatures, e.g., 10,000° F., and can operate at temperatures much higher than can be obtained by combustion, thereby providing optimum operating efficiency for any grade or type of coal. Also, the heat transfer particularly during devolatilization and the incoming gravity fall of the particulate coal can be controlled to effect almost instantaneous devolatilization.

(C) The long arc torches which establish the electric arc and long arc plasma columns are not required to be rotated during the gasification process and at times may use char as an electrode.

(D) Since it is not necessary to pass air, oxygen or steam through a bed of coal according to the invention, substantially any grade or type of input coal can be gasified. The invention apparatus does not require grates which can plug with fused char and ash or melt with high temperature. High ash coal, caking coal and high Btu coal may be used. The heating value of the raw gas has a relatively high Btu content per unit volume. The gas is not diluted with nitrogen or other diluting products inherent in processes using combustion. The raw gas volume is reduced considerably because of the absence of these dilutants, increasing efficiency of the system and reducing and simplifying gas cleaning equipment when needed. The ferrous melt also reduces the pyritic sulfur.

(E) Either a single type or plural types of raw gas and raw gas of different gas ratio composition can be obtained even though common coal, power and steam supplies are employed to service the gasification process.

(F) The process can be rapidly started up and brought into operation and/or shut-down in a very short time. The invention system is essentially non-mechanical, thereby reducing capital cost and operating and maintenance costs.

(G) The invention can be easily modularized and field constructed from mass-produced components.

(H) The furnace design is of comparative small volume and can be easily scalable. The torch power consumption per ton of coal and the operating efficiency will remain essentially the same, and the inherent advantages of the gasifier system can be realized with a plant size of virtually any capacity.

(I) The invention system has higher plant output capacity per unit of input coal because all of the input coal is converted into gas and none is burned to generate heat.

(J) The high operating temperature allows high utilization of steam or water which reduces both the amount of reactant as well as the amount of water required to be condensed from the raw gas.

(K) Devolatilization and gasification are accomplished in a single stage.

(L) A high pressure vessel construction is not required. The gasification may take place at a pressure only slightly above atmospheric.

(M) Only steam is required to be heated as a gasification reactant. All combustion type prior art processes must heat steam plus large volumes of either air or oxygen. Without a reactant the system can produce useful coke.

It should be noted that the process of the invention can be modified to eliminate the steam injection by introducing the input coal in a slurry consisting of approximately 30 to 60% water by weight. The slurry system would have the advantages of eliminating the steam generator equipment and reducing the amount of air introduced into the furnace with the input coal, it being recognized that the introduction of dry pulverized coal necessarily involves introduction of some air in the interstices of the coal particles.

It should also be pointed out that the preferred plasma gas for use by torches 12 is air. The mass flow rate of the plasma gas is, however, negligible in view of the overall flow rate of the raw gas; therefore, the plasma gas does not serve to appreciably dilute or react with the char or with the raw gas. The air introduced through the torch as the plasma gas represents approximately one-thousandth of the air which would be required by combustion to achieve the same heating effect.

A preferred method of practicing the present invention is as follows:

Step 1—Providing a furnace with a hearth for holding an electrically conductive material to form the "melt" as described.

Step 2—Heating the furnace by a selected number of long arc plasma torches using the melt as the external electrode.

Step 3—Bringing the refractory lining of the furnace to a sufficiently high operating temperature, e.g., 1000° C.

Step 4—Melting a portion of the melt material and allowing a molten layer to form thereon so as to be electrically contacted by each of the arcs.

Step 5—Introducing input coal in plural streams. Alternative (a) pulverized coal plus steam injection. Alternative (b) coal-water slurry. Supply rate and coal size are controlled.

Step 6—Devolatilizing the coal in the furnace atmosphere as it falls toward the melt surface in a very rapid reaction. In addition, the long chain volatile gases are cracked during this process.

Step 7—Allowing the carbon-rich char to settle on the surface of the melt in independently movable deposits, thereby causing the char to move on the melt surface according to the currents imposed on the melt surface by the plasma torches, and allowing the fixed carbon to react with steam according to the following three stoichiometric reactions over a time interval:

$$C+H_2O \rightarrow CO+H_2 \quad (1)$$

$$C+2H_2O \rightarrow CO_2+2H_2 \quad (2)$$

$$C+2H_2 \rightarrow CH_4 \quad (3)$$

Step 8—Controlling the process by temperature responsive control of the power input to the long arc plasma torches, thereby assuring proper residence time and optimum coal utilization.

Step 9—Removing the raw gas continuously at some rate.

Step 10—Removing excess slag:

(1) Continuously; or (2) At intervals.

Variations on the foregoing method are, of course described in connection with FIGS. 14, 15 and 15A and elsewhere in the description and will vary with reactant, carbonaceous matter, raw gas, etc.

In summary, the gasification system of the present invention provides an ideal means for the efficient gasification of coal and other carbonaceous matter. It is foreseeable that future uses of such systems will include the gasification of biomass such as cut trees and cornstalks. Also envisioned is the gasification of lignite, bitumen, kerogen and many other natural materials which lend themselves to being divided or otherwise placed in a size controlled, particulate form for rapid devolatilization with the remaining fixed carbon content being gasifiable or distillable, as appropriate, and having Btu content which justify their gasification into fuel.

Figure 18:
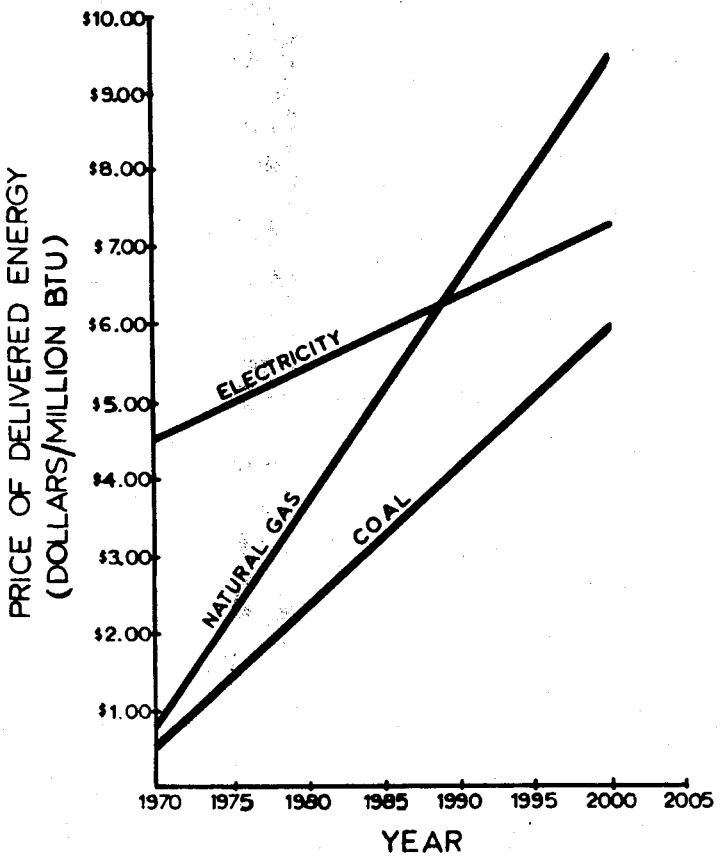
FIG. 18 is a graph showing the projected relative prices of delivered electricity, coal and natural gas over a 30- year period.

Although the present invention may be used on a sound economic and ecological basis at the present time, the gasification of coal and other carbonaceous matter by electrical means will prove to be extremely desirable in the foreseeable future. The graph shown in FIG. 18 illustrates a possible comparison between the relative prices of energy from three sources over a thirty-year period. Due to the realization that coal is the only abundant fossil fuel remaining in the United State and due to other factors well known among those skilled in the art, it is highly probable that the cost of coal will increase rapidly. With the proven cleanliness and efficiency of natural gas as a fuel and the scarcity of such gas, it is believed reasonable to assume that the cost of natural gas will increase even more dramatically than coal. However, the successful development and commercialization of nuclear power plants and breeder reactors may very well keep down the rate of increase in the cost of electricity. Given this possible state of economic affairs in the energy field, the gasification of coal by means of electrical energy to produce a pipeline quality gas will become highly desirable and, indeed, is an optimum conversion of energy from one form to another. The economic advantage of supplying the endothermic heat to the gasification process by electrical plasma torches instead of by combustion of a part of the coal may become an extremely important factor in the foreseeable future, as the coal is saved for energy conversion to gas rather than for combustion.

Also to be noted in respect to future applications is the fact that by operating plural compartments or plural furnaces as illustrated in FIGS. 13, 14, 15, 15A, a common power supply, a common steam supply and a common coal supply could be used to provide a variety of gases for use in a given region. Equally significant is the potential use of the system and method of the invention as a hydrogen source or as a source of a reactant gas for iron ore reduction at a site having both coal and iron ore available. The system and process of the invention also lends itself to a variety of control systems. For example, in a furnace configuration such as illustrated in FIGS. 1 and 2, the torches could have individual or a common power control. With individual control, temperature could be sensed in the vicinity of each torch and the torch power regulated accordingly. Temperature can also be sensed at a single representative point or at several points and averaged into a single temperature for control purposes. Also, the coal feeds and steam feeds to each torch vicinity could be under a common or individual control depending on such factors as the specific furnace design, localized heat losses, uniformity of coal, quality of raw gas desired and the like. That is, it is contemplated that in a FIG. 1 type configuration, the amount of coal and steam fed, and the amount of power applied may vary at least slightly from torch site to torch site.

With plural chambers such as illustrated in FIGS. 14 and 15 it will also be apparent that the rate of raw gas withdrawal, rate of coal feed and corresponding rate of steam feed, as well as temperature and torch power can all be regulated on an individual furnace basis to optimize conditions in each respective furnace for the particular raw gas and gas ratio desired.

What is claimed is:

1. A method for producing fuel gases from particulate carbonaceous matter comprising the steps of:

(a) providing a refractory-lined furnace vessel characterized by the presence of a hearth member containing an electrically conductive refractory material, an unobstructed chamber area positioned immediately above and encompassing said hearth member, substantially air-tight means for continuously introducing said carbonaceous matter at a controlled rate into said furnace from an elevated position therein, means for admitting a carbon combining reactant into said furnace, means for removing product gases and ash residue from said furnace, said wherein said furnace is further characterized by the presence of one or more electrically powered and gas supplied long arc plasma torches mounted in the walls thereof with the respective arc sustaining ends of each of said torches being directed toward said hearth;

(b) striking an initial plasma arc between each of said plasma torches and said electrically conductive material contained in said hearth member and thereafter supplying sufficient power to said torches to bring the interior chamber area of said furnace vessel to a substantially uniform and stable, preselected temperature of at least 800° C., with said uniformity of temperature being achieved by the radiation of heat from the internal surfaces of said furnace vessel;

(c) continuously introducing a charge of particulate carbonaceous matter into said furnace from an elevated position therein and in a manner such as to substantially preclude atmospheric air from entering the interior of said furnace, the rate of said introduction being correlated with and dependent upon said furnace chamber temperature, said particulate carbonaceous matter charge being characterized by a substantially uniform fixed carbon content and having a particle size of less than about $\frac{3}{4}$ inch;

(d) permitting said carbonaceous matter to fall by gravity over a predetermined distance from said elevated position to the surface of said electrically conductive material contained in said hearth member, wherein during the course of said fall the carbonaceous matter is devolatilized and the volatiles so obtained are thermally cracked to produce short chain hydrocarbons;

(e) allowing the devolatilized carbonaceous matter to continuously deposit as char on the surface of said conductive material in a single level, non-tiered array at a selected number of gasification sites, the quantity and configuration of said char deposits being controlled such that the unoccupied volume and free surface area of said furnace are maintained in substantial excess over that of the combined volume and surface area of said deposits;

(f) simultaneously with the introduction of said carbonaceous matter introducing substantially stoichiometric quantities of a carbon combining reactant into said furnace vessel for reaction with the fixed carbon of said char deposits to produce fuel gases therefrom, wherein said carbon combining reactant is selected from the group consisting of hydrogen, ammonia and water, with said water being introduced in the form of steam or as a liquid;

(g) monitoring the interior temperature of said furnace vessel and varying the power supplied to said plasma torches during temperature fluctuations therein to maintain the temperature at said preselected level;

(h) continuously withdrawing the gaseous products produced in said furnace; and (i) removing accumulated residual ash from the hearth of said furnace in a continuous manner or at selected intervals.

2. The method in accordance with claim 1, wherein said preselected chamber temperature is in the range of from about 800° C. to 2000° C.

3. The method of claim 2, wherein said preselected temperature is 1000° C.

4. The method in accordance with claim 1, wherein said furnace is operated at an internal pressure of from about 2 kg/cm$^2$ to 100 kg/cm$^2$.

5. The method of claim 4 wherein said pressure is about 3 kg/cm$^2$.

6. The method of claim 4 wherein said furnace is pressurized by controlling the rate at which the product gases are withdrawn.

7. The method of claim 1 wherein said carbon combining reactant is steam.

8. The method in accordance with claim 1 wherein said carbonaceous matter is selected from the group consisting of plastics, sawdust, biomass, discarded tires, kerogen, bitumen, lignite and coal.

9. The method in accordance with claim 1 wherein said carbonaceous matter is coal.

10. The method of claim 1 wherein each of said plasma torches is a long arc plasma torch adapted to establish and maintain a plasma column having a length of at least 0.3 meter.

11. The method of claim 1 wherein said carbon combining reactant is water intermixed with said carbonaceous matter before said carbonaceous matter is introduced into said furnace.

12. The method of claim 1 wherein the manner of introducing said carbonaceous matter into said furnace consists of air lock feeding so as to minimize introduction of atmospheric air into the interior of said furnace.

13. The method of claim 1 wherein said carbonaceous matter is introduced into said furnace through air lock feeder means and in plural streams filtered of atmospheric air and in a manner adapted to establish plural said gasifying sites.

14. A method for producing fuel gases from particulate carbonaceous matter comprising the steps of:

(a) providing a refractory-lined furnace vessel characterized by the presence of a hearth member, an unobstructed chamber area positioned immediately above and encompassing said hearth member, substantially air-tight means for continuously introducing said carbonaceous matter at a controlled rate into said furnace from an elevated position therein, means for admitting a carbon combining reactant into said furnace, means for removing the product gases and ash residue from said furnace, and wherein said furnace is further characterized by the presence of one or more electrically powered and gas supplied long arc plasma torches mounted in the walls thereof with the respective arc sustaining ends of each of said torches being directed toward said hearth;

(b) placing a selected volume of an electrically conductive and meltable metal composition which contains slagging components into said hearth member;

(c) striking an initial plasma arc between each of said plasma torches and said electrically conductive and meltable metal composition and thereafter supplying sufficient power to said torches to form an electrically conductive molten metal bath having a molten slag-containing surface layer within said hearth member and to bring the internal chamber area of said furnace vessel to a substantially uniform and stable preselected temperature of at least 800° C., with said uniformity of temperature being achieved by the radiation of heat from the internal surfaces of said furnace vessel;

(d) continuously introducing a charge of particulate carbonaceous matter into said furnace from an elevated position therein and in a manner such as to substantially preclude atmospheric air from entering the interior of said furnace, the rate of said introduction being correlated with and dependent upon said furnace chamber temperature, said particulate carbonaceous matter charge being characterized by a substantially uniform fixed carbon content and having a particle size of less than about $\frac{3}{4}$ inch;

(e) permitting said carbonaceous matter to fall by gravity over a predetermined distance from said elevated position to said surface layer of said electrically conductive molten bath to effect a devolatilization of said carbonaceous matter together with a subsequent cracking of the resulting volatiles during the course of said fall;

(f) allowing the devolatilized carbonaceous matter to continuously deposit as a char and float on the slag surface layer of said melt in a single level, nontiered array at a selected number of gasification sites, the quantity and configuration of said char deposits being controlled such that the unoccupied volume and free surface area of said furnace are maintained in substantial excess over that of the combined volume and surface area of said deposits;

(g) simultaneously with the introduction of said carbonaceous matter introducing substantially stoichiometric quantities of a carbon combining reactant into said furnace vessel for reaction with the fixed carbon of said char deposits to produce fuel gases therefrom, wherein said carbon combining reactant is selected from the group consisting of hydrogen, ammonia and water, with said water being introduced as steam or in the liquid state;

(h) monitoring the interior temperature of said furnace vessel and varying the power supplied to said plasma torches during temperature fluctuations therein to maintain the temperature at said preselected level;

(i) continuously withdrawing the gaseous products produced in said furnace; and (j) removing accumulated residual ash from the hearth of said furnace continuously or at selected intervals.

15. The method in accordance with claim 14 wherein said preselected chamber temperature is in the range of from about 800° to 2000° C.

16. The method of claim 15 wherein said preselected temperature is 1000° C.

17. The method in accordance with claim 14 wherein said furnace is operated at an internal pressure of from about 2 kg/cm$^2$ to 100 kg/cm$^2$.

18. The method of claim 14 wherein said pressure is about 3 kg/cm$^2$.

19. The method of claim 14 wherein said carbon combining reactant is steam.

20. The method in accordance with claim 14 wherein said carbonaceous matter is selected from the group consisting of plastics, sawdust, biomass, discarded tires, kerogen, bitumen, lignite and coal.

21. The method in accordance with claim 14 wherein said carbonaceous matter is coal.

22. The method of claim 14 wherein said plasma torch is angled with respect to said slag layer so as to allow its plasma arc column to form a repetitive eddy current pattern on the surface of said layer, and wherein said char deposits on said slag layer are so positioned as to be moved by said current pattern during the gasification thereof.

23. The method of claim 22 wherein each torch is angled to allow the plasma arc column thereof to strike the slag layer of said molten metal bath at an angle of between 30° and 60° off the vertical to effectuate said eddy current pattern.

24. The method of claim 14 wherein said vessel is compartmentalized into plural compartments with the supply of said carbonaceous matter being arranged to feed each compartment with each compartment having a said torch powered by and controlled from a single said power supply, with each compartment arranged to receive a selected said reactant and with said various compartments having electrically interconnected said melt material and being adapted to produce either the same or plural types of said fuel gas, and including selecting the respective reactant, temperature and pressure for each said compartment and operating accordingly.

25. The method of claim 14 wherein said selected number of torches comprises a plural number operated from a common controllable power supply and each said plasma torch comprises a long arc column plasma torch adapted to establish and maintain a plasma column having a length of at least 0.3 meter.

26. The method of claim 14 wherein said carbonaceous matter contains pyritic sulfur and said melt material is ferrous containing and including the step of allowing said material to combine with said pyritic sulfur to produce a pyritic sulfur slag floating on the slag of said melt as part of said residue.

27. The method of claim 14 wherein said reactant is water intermixed with said carbonaceous matter before introduction of said carbonaceous matter into said furnace vessel.

28. The method of claim 19 including the step of producing said steam in a steam generator by the use of a portion of the sensible heat of said produced fuel gas.

29. The method of claim 24 wherein each said compartment has a common said melt material.

30. The method of claim 24 wherein said compartments have separate, physically isolated electrically conducting melt materials.

31. The method of claim 24 wherein said carbonaceous matter is coal and said reactant is steam fed from a common supply to each said compartment.

32. The method of claim 22 wherein said carbonaceous matter is coal and said eddy current pattern at each said torch comprises elliptical cusping eddy currents maintained on both sides of each said torch plasma arc column.

* * * * *

UNITED STATES PATENT AND TRADEMARK OFFICE

CERTIFICATE OF CORRECTION

PATENT NO. : 4,181,504

DATED : January 1, 1980

INVENTOR(S) : Salvador L. Camacho

It is certified that error appears in the above—identified patent and that said Letters Patent is hereby corrected as shown below:

Col. 2, line 4, "gate" should be --grate--.

Col. 4, line 66, "exthothermic" should be --exothermic--

Col. 6, line 62, "are" should be --arc--.

Col. 9, line 60, "have" should be --has--.

Col. 21, line 9, "State" should be --States--.

Col. 22, line 10, 1st occurrence of "said" should be --and--.

Signed and Sealed this

*First* Day of *July 1980*

[SEAL]

*Attest:*

SIDNEY A. DIAMOND

*Attesting Officer*

*Commissioner of Patents and Trademarks*